US007735273B2

(12) United States Patent
Knepp et al.

(10) Patent No.: US 7,735,273 B2
(45) Date of Patent: Jun. 15, 2010

(54) POURED CONCRETE COLUMN HOLE

(75) Inventors: Wayne A. Knepp, Morton, IL (US); David E. Laux, East Peoria, IL (US); Kevin Potter, Washington, IL (US)

(73) Assignee: Morton Buildings, Morton, IL (US)

( * ) Notice: Subject to any disclaimer, the term of this patent is extended or adjusted under 35 U.S.C. 154(b) by 0 days.

(21) Appl. No.: 11/531,604

(22) Filed: Sep. 13, 2006

(65) Prior Publication Data

US 2007/0175136 A1 Aug. 2, 2007

Related U.S. Application Data

(60) Provisional application No. 60/759,366, filed on Jan. 17, 2006, provisional application No. 60/759,485, filed on Jan. 17, 2006.

(51) Int. Cl.
*E02D 27/32* (2006.01)

(52) U.S. Cl. ..... 52/294; 52/295; 52/296; 52/169.9; 405/232; 405/233; 405/239; 405/231; 405/229

(58) Field of Classification Search ..... 52/295, 52/296, 741.14, 169.9; 405/239, 233, 232, 405/231, 229

See application file for complete search history.

(56) References Cited

U.S. PATENT DOCUMENTS

| | | | |
|---|---|---|---|
| 727,583 | A | 5/1903 | Brown |
| 2,332,168 | A | 10/1943 | Riches |
| 3,464,216 | A | 9/1969 | Turzillo |
| 3,540,225 | A | 11/1970 | Muller |
| 3,654,767 | A | 4/1972 | Cavin |

(Continued)

FOREIGN PATENT DOCUMENTS

| | | |
|---|---|---|
| EP | 0302717 | 3/1988 |

(Continued)

*Primary Examiner*—Richard E Chilcot, Jr.
*Assistant Examiner*—Mark R Wendell
(74) *Attorney, Agent, or Firm*—Howard & Howard Attorneys PLLC

(57) ABSTRACT

A form system is provided for forming a structural column assembly of the type used for erecting building structures and the like, such as a concrete column or footing formed in situ in an earthen hole. The system includes a support system, including a wire support member and an associated base foam ring having an offset center hole corresponding to the centerline of the concrete footing, which is placed at the bottom of the earthen hole. A lower vertical form system, including multiple interlocking pieces, is assembled and joined at one end to an offset disk member. The disk member of the lower vertical form system is then placed onto the base foam ring in abutting engagement. The form system is then plumbed and positioned, e.g., in relation to one or more layout strings. Once the form system is in the correct position, the earthen hole is backfilled, e.g., with dirt or other material, thus holding the properly positioned form system in place. The lower vertical form system is then cut to grade. Reinforcing assemblies, such as rebar, can then be inserted into the lower vertical form system. Concrete can then be poured into the lower vertical form system, thus forming a lower portion of the concrete column or footing. An upper vertical form system can then be used to form the upper portion of the concrete column or footing, e.g., that portion that is above grade.

35 Claims, 17 Drawing Sheets

U.S. PATENT DOCUMENTS

| | | | | |
|---|---|---|---|---|
| 3,727,599 | A | | 4/1973 | Sugiki et al. |
| 3,757,528 | A | | 9/1973 | Finsterwalder et al. |
| 3,962,879 | A | | 6/1976 | Turzillo |
| 3,980,268 | A | | 9/1976 | Ellis |
| 4,124,015 | A | | 11/1978 | Isaksson |
| 4,144,867 | A | | 3/1979 | Wachs et al. |
| 4,180,047 | A | | 12/1979 | Bertelson |
| 4,197,828 | A | | 4/1980 | Schellhorn |
| 4,233,954 | A | | 11/1980 | Visser |
| 4,242,013 | A | | 12/1980 | Watts |
| 4,318,391 | A | | 3/1982 | Wachs et al. |
| 4,327,703 | A | | 5/1982 | Destree |
| 4,368,720 | A | | 1/1983 | Destree |
| 4,570,409 | A | | 2/1986 | Wilks |
| 4,627,211 | A | | 12/1986 | Foster, Jr. |
| 4,673,157 | A | | 6/1987 | Wells |
| 4,767,241 | A | | 8/1988 | Wells |
| 5,090,397 | A | | 2/1992 | Larsen et al. |
| 5,139,006 | A | | 8/1992 | Trudeau |
| 5,359,829 | A | | 11/1994 | Voita |
| 5,437,519 | A | | 8/1995 | Bullivant |
| 5,542,785 | A | | 8/1996 | Cloud |
| 5,746,036 | A | * | 5/1998 | Angelette ..... 52/295 |
| 5,961,253 | A | | 10/1999 | Okawa |
| 5,984,587 | A | | 11/1999 | Odle |
| 6,050,034 | A | * | 4/2000 | Krinner ..... 52/155 |
| 6,062,771 | A | | 5/2000 | Roberts |
| 6,487,781 | B2 | | 12/2002 | Johnson |
| 6,705,058 | B1 | * | 3/2004 | Foust et al. ..... 52/720.1 |
| 6,773,208 | B2 | | 8/2004 | DeWitt et al. |
| 2006/0254068 | A1 | * | 11/2006 | Shotton et al. ..... 33/544 |

FOREIGN PATENT DOCUMENTS

| | | |
|---|---|---|
| JP | 10317374 | 2/1998 |
| WO | WO2004081294 | 9/2004 |
| WO | WO2006001589 | 1/2006 |

* cited by examiner

POURED CONCRETE COLUMN HOLE

CROSS-REFERENCE TO RELATED APPLICATION

The instant application claims priority to U.S. Provisional Application Ser. Nos. 60/759,366, filed Jan. 17, 2006, and 60/759,485, filed Jan. 17, 2006, the entire specifications of both of which are expressly incorporated herein by reference.

FIELD OF THE INVENTION

The present invention relates generally to concrete forms such as those used in the construction of buildings, structures and/or the like, and more particularly relates to form systems such as those for use with in situ formation of a concrete column or footing in an excavated hole.

BACKGROUND OF THE INVENTION

Structural column assemblies of the type used for post-frame construction and pole frame structures typically include an elongated wooden post having a bottom end anchored in the earth and a top, free standing end fixed in an upright position upon which framing, trusses or other structural elements are then attached. The bottom end of the post is typically supported in the earthen hole by either back-filled dirt or gravel or perhaps by concrete formed in situ thereabout.

In many applications, building codes require a concrete footing of perhaps 8 inches or 12 inches, for example, to be formed under the bottom of the column post. Examples of such concrete footings are poured concrete footings, wherein a form, such as circular forms, is typically placed in the earthen hole at a precise location, at a precise orientation (e.g., level and plumb), and at precise depth. The positioning of the concrete form was generally time-consuming, laborious and haphazard and was typically accomplished with a combination of alignment strings, levels (e.g., torpedo levels), and/or visual inspection (e.g., "eyeballing"). Once the positioning of the form was set, the concrete mixture would then be poured into the form, wherein it was then allowed to sufficiently cure or harden, thus providing the requisite support and/or load distribution to the structure to be built thereon. However, problems occurred when the precision of the location, orientation and/or depth of the form was not within acceptable limits, which lead to poorly aligned and/or positioned concrete footings which adversely affected the structural integrity of the structure built thereupon.

Accordingly, there is a need for new and improved form systems for producing poured concrete columns or footings in excavated holes that overcome at least one of the disadvantages and shortcomings existing in the prior art.

SUMMARY OF THE INVENTION

In accordance with the general teachings of the present invention, a form system is provided for forming a structural column assembly of the type used for erecting building structures and the like, such as a concrete footing formed in situ in an earthen hole. Also provided are methods for making and using the form systems of the present invention.

The form system includes a support system, including a wire support member and an associated base foam ring having an offset center hole corresponding to the centerline of the concrete footing, which is placed at the bottom of the earthen hole. A lower vertical form system, including multiple interlocking pieces, is assembled and joined at one end to an offset disk member. The disk member of the lower vertical form system is then placed onto the base foam ring in abutting engagement. The form system is then plumbed and positioned, e.g., in relation to one or more layout strings. Once the form system is in the correct position, the earthen hole is backfilled, e.g., with earth or other material, thus holding the properly positioned form system in place. The lower vertical form system is then cut to grade. Reinforcing assemblies, such as rebar, can then be inserted into the lower vertical form system. Concrete can then be poured into the lower vertical form system, thus forming a lower portion of the concrete footing. An upper vertical form system can then be used to form the upper portion of the concrete footing, e.g., that portion that is above grade.

In accordance with a first embodiment of the present invention, a form system for forming a structural element in situ in an earthen hole is provided, comprising: (1) a support member disposed in the earthen hole; (2) a disk member disposed on top of the support member, wherein the disk member includes an area defining an offset aperture formed therein; and (3) a lower vertical form system disposed on top of the disk member, wherein the lower vertical form system includes a wall member having an outer face and an inner face, wherein the wall member defines a throughbore extending from a first end of the lower vertical form system to a second end of the lower vertical form system.

In accordance with one aspect of this embodiment, the structural element is comprised of a concrete column or footing.

In accordance with another aspect of this embodiment, a second disk member is disposed about either the first end or the second end of the wall member of the lower vertical form system, wherein the second disk member includes an area defining a second offset aperture formed therein, wherein the second disk member and the disk member are operable to be brought into abutting engagement such that at least a portion of the aperture of the disk member and the second aperture of the second disk member are coaxially aligned.

In accordance with still another aspect of this embodiment, an upper vertical form system is disposed on a surface of the lower vertical form system, wherein the upper vertical form system includes a wall member having an outer face and an inner face, wherein the wall member defines a throughbore extending from a first end of the upper vertical form system to a second end of the upper vertical form system, wherein at least a portion of the throughbore of the lower vertical form system and the throughbore of the upper vertical form system are coaxially aligned.

In accordance with yet another aspect of this embodiment, either the lower vertical form system or the upper vertical form system includes a plurality of interlocking wall portions operable to form a substantially cylindrical member.

In accordance with still yet another aspect of this embodiment, a reinforcement assembly is disposed in either the lower vertical support system or the upper vertical support system, wherein the reinforcement assembly includes a first portion and a second portion disposed on the first portion, wherein the first portion comprises a plurality of substantially elongated reinforcement members in fixed relationship to one another, wherein the second portion includes a bracket member fastened to an end portion of at least one of the reinforcement members.

In accordance with a further aspect of this embodiment, the support member comprises a cage member having a first end and a spaced and opposed second end defining a throughbore therebetween, wherein at least a portion of the throughbore of the support member is coaxially aligned with the throughbores of the lower vertical form system and the upper vertical form system, such that a curable material introduced into an open end of the upper vertical form system is operable to flow into the throughbore of the support member and substantially envelop the reinforcement assembly.

In accordance with a still further aspect of this embodiment, the lower vertical form system is disposed entirely within the earthen hole and fully recessed below a grade surface thereof and the upper vertical form system is located above a grade surface of the earthen hole.

In accordance with a first alternative embodiment of the present invention, a method for forming a structural element in situ in an earthen hole is provided, comprising: (1) providing a form system comprising a support member, a disk member, and a lower vertical form system; (2) placing the support member on a floor surface of the earthen hole; (3) placing the disk member on top of the support member, wherein the disk member includes an area defining an offset aperture formed therein; and (4) placing the lower vertical form system on top of the disk member, wherein the lower vertical form system includes a wall member having an outer face and an inner face, wherein the wall member defines a throughbore extending from a first end of the lower vertical form system to a second end of the lower vertical form system.

In accordance with one aspect of this embodiment, the structural element is comprised of a concrete column or footing.

In accordance with another aspect of this embodiment, a second disk member is provided, wherein the second disk member is disposed about either the first end or the second end of the wall member of the lower vertical form system, wherein the second disk member includes an area defining a second offset aperture formed therein, wherein the second disk member and the disk member are operable to be brought into abutting engagement such that at least a portion of the aperture of the disk member and the second aperture of the second disk member are coaxially aligned.

In accordance with still another aspect of this embodiment, an upper vertical form system is provided, wherein the upper vertical form system is disposed on a surface of the lower vertical form system, wherein the upper vertical form system includes a wall member having an outer face and an inner face, wherein the wall member defines a throughbore extending from a first end of the upper vertical form system to a second end of the upper vertical form system, wherein at least a portion of the throughbore of the lower vertical form system and the throughbore of the upper vertical form system are coaxially aligned.

In accordance with a yet another aspect of this embodiment, either the lower vertical form system or the upper vertical form system includes a plurality of interlocking wall portions operable to form a substantially cylindrical member.

In accordance with still yet another aspect of this embodiment, a reinforcement assembly is provided, wherein the reinforcement assembly is disposed in either the lower vertical support system or the upper vertical support system, wherein the reinforcement assembly includes a first portion and a second portion disposed on the first portion, wherein the first portion comprises a plurality of substantially elongated reinforcement members in fixed relationship to one another, wherein the second portion includes a bracket member fastened to an end portion of at least one of the reinforcement members.

In accordance with a further aspect of this embodiment, the support member comprises a cage member having a first end and a spaced and opposed second end defining a throughbore therebetween, wherein at least a portion of the throughbore of the support member is coaxially aligned with the throughbores of the lower vertical form system and the upper vertical form system, such that a curable material introduced into an open end of the upper vertical form system is operable to flow into the throughbore of the support member and substantially envelop the reinforcement assembly.

In accordance with a still further aspect of this embodiment, the lower vertical form system is disposed entirely within the earthen hole and fully recessed below a grade surface thereof and the upper vertical form system is located above a grade surface of the earthen hole.

Further areas of applicability of the present invention will become apparent from the detailed description provided hereinafter. It should be understood that the detailed description and specific examples, while indicating the preferred embodiment of the invention, are intended for purposed of illustration only and are not intended to limit the scope of the invention.

BRIEF DESCRIPTION OF THE DRAWINGS

The present invention will become more fully understood from the detailed description and the accompanying drawings, wherein.

The same reference numerals refer to the same parts throughout the various Figures.

DETAILED DESCRIPTION OF THE INVENTION

Figure 1:
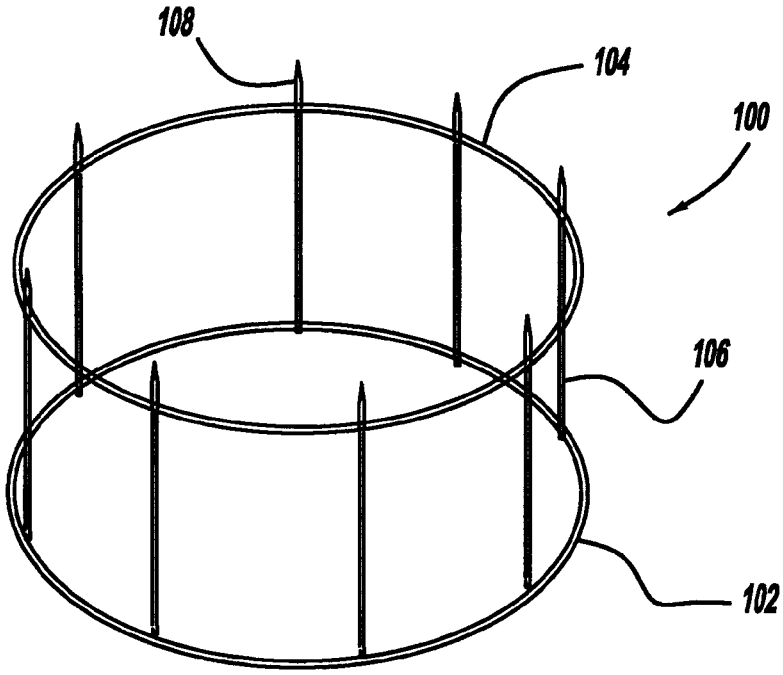
FIG. 1 is a perspective view of a wire support member, in accordance with a first embodiment of the present invention.

The following description of the preferred embodiment(s) is merely exemplary in nature and is in no way intended to limit the invention, or uses.

Referring to the Figures generally, wherein like numerals indicate like or corresponding parts throughout several views, a form system is generally shown at 10 for use with a poured concrete column earthen hole 20 for in situ formation of a concrete column or footing 30. That is, the concrete column or footing 30 is not of the pre-cast type, but rather of that type that is intended to be formed in situ in the earthen hole 20, as will be described herein.

As is known in the art, the earthen hole 20 can be formed or excavated in any number of ways and typically defines a below grade portion 22 and an above grade portion 24. By way of a non-limiting example, the earthen hole 20 can be formed or excavated by any of the known techniques, including but not limited to digging or boring to a depth which is prescribed by local building codes or customs. The depth can be measured longitudinally from the surrounding grade surface 26 to a floor 28 of the earthen hole 20. Typically, the earthen hole 20 will be cylindrical in form, but other shapes are possible. While the concrete column or footing 30 is intended to be formed in the earthen hole 20 in the earth per se, it should be appreciated that foreseeable circumstances may require formation of a hole in some substance other than earth, and that such a hole remains within the meaning of "earthen hole" as that phrase is used here throughout.

By way of a non-limiting example, variable diameter earthen holes 20 are typically formed or excavated at variable depths depending on the loads needed for each particular building or structure column. For example, the precise earthen hole 20 layout pattern can be determined from various sources, including but not limited to the building plan drawings, blueprints, site surveys, and/or the like. A typical earthen hole 20 is shown in cutaway view in FIG. 3.

Figure 2:
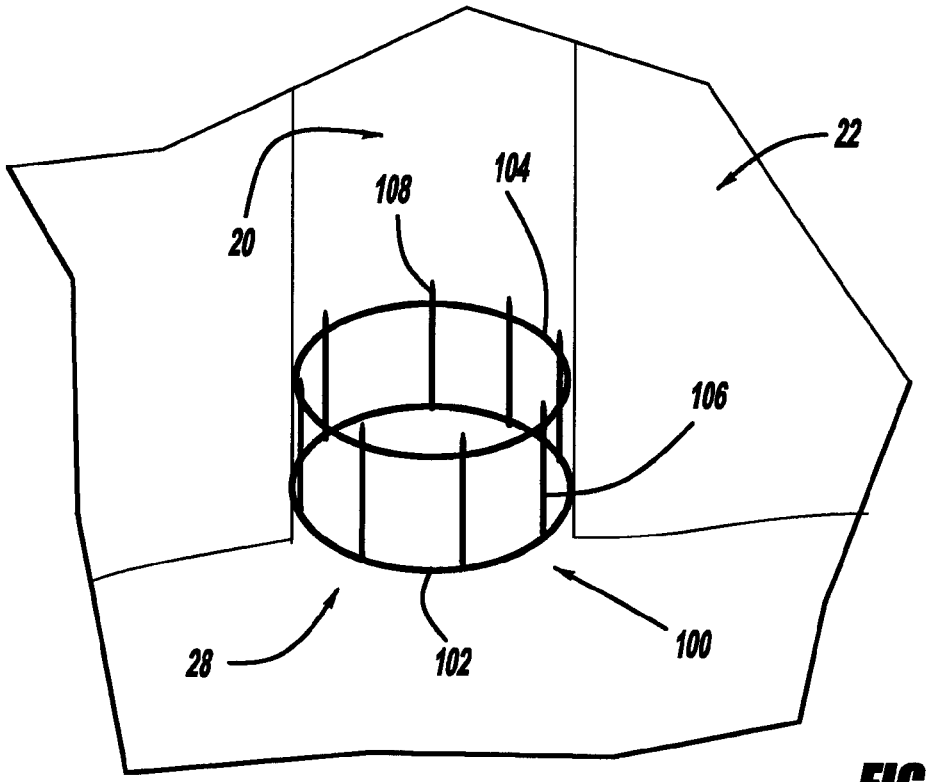
FIG. 2 is a perspective view of the wire support member depicted in FIG. 1, in situ in an earthen hole, in accordance with a second embodiment of the present invention.
Figure 3:
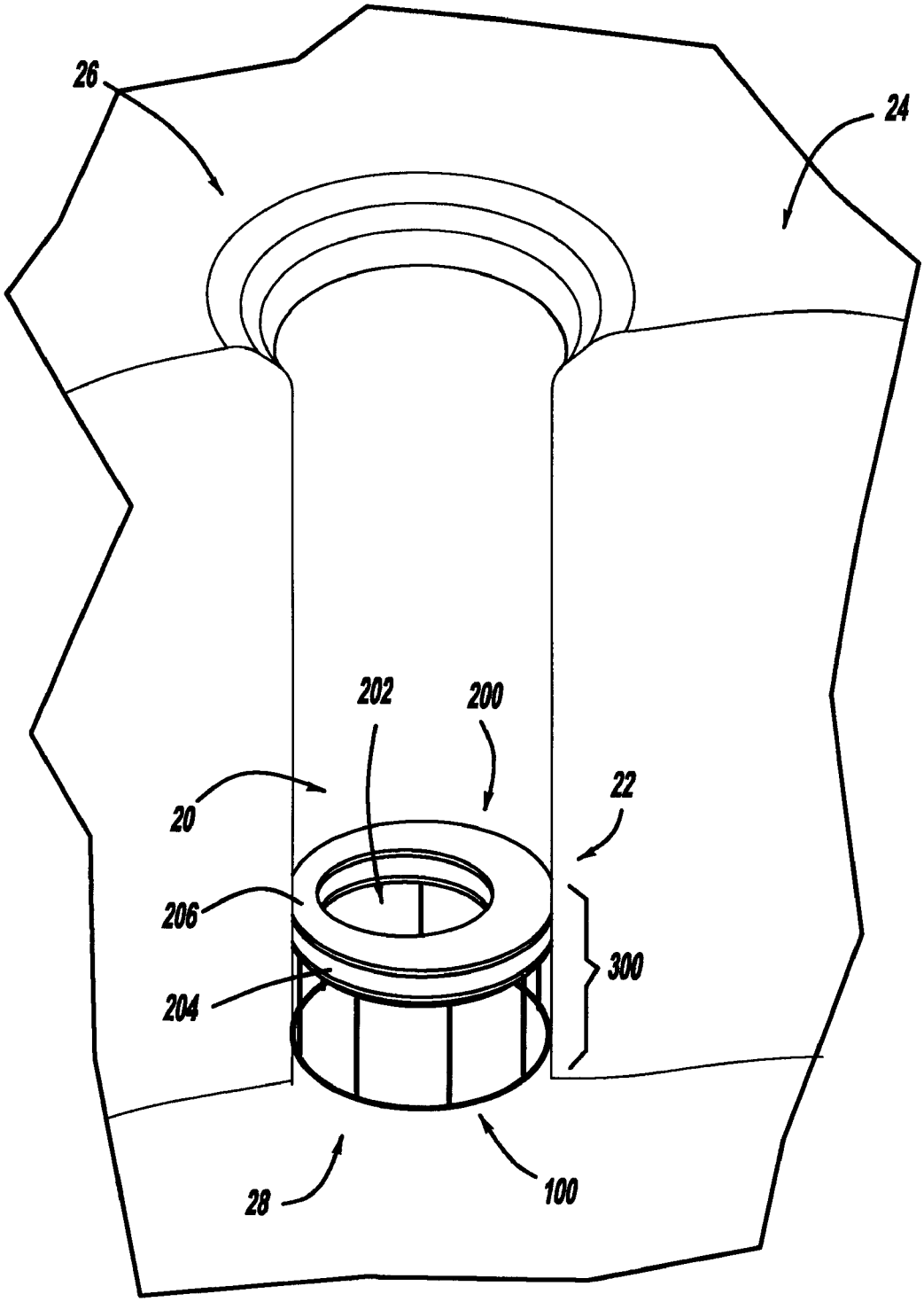
FIG. 3 is a perspective view of a base foam ring disposed on the wire support member depicted in FIG. 1, in situ in an earthen hole, in accordance with a third embodiment of the present invention.
Figure 4:
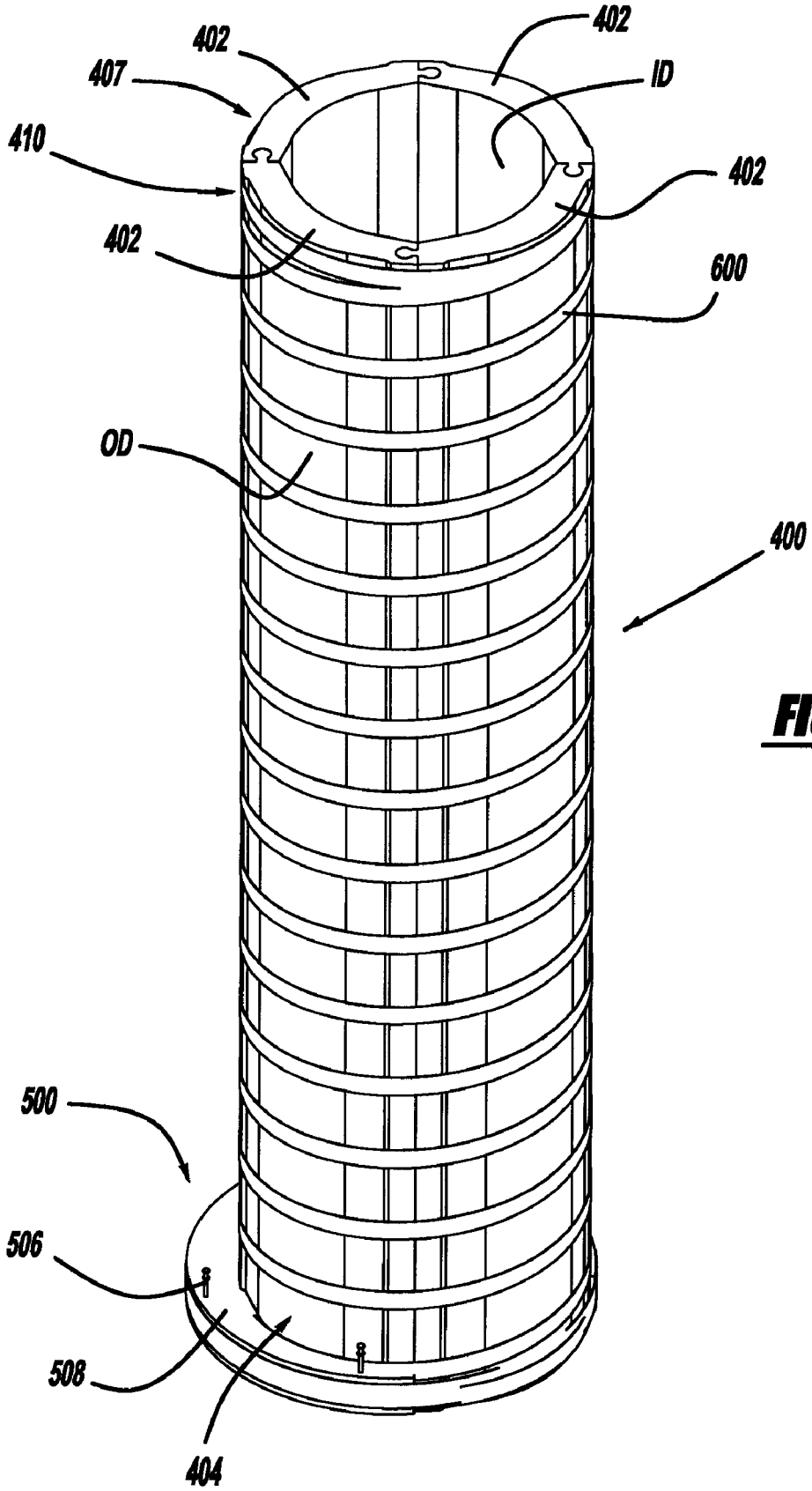
FIG. 4 is a perspective view of a lower vertical form system, in accordance with a fourth embodiment of the present invention.
Figure 5:
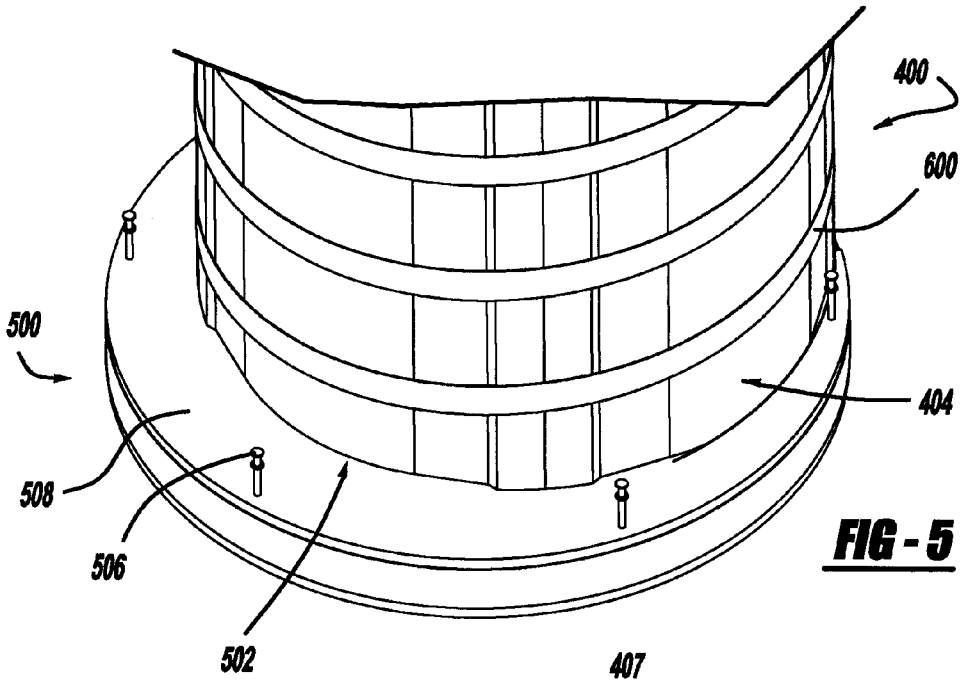
FIG. 5 is a partial perspective view of a bottom portion of the lower vertical form system depicted in FIG. 4, in accordance with a fifth embodiment of the present invention.
Figure 6:
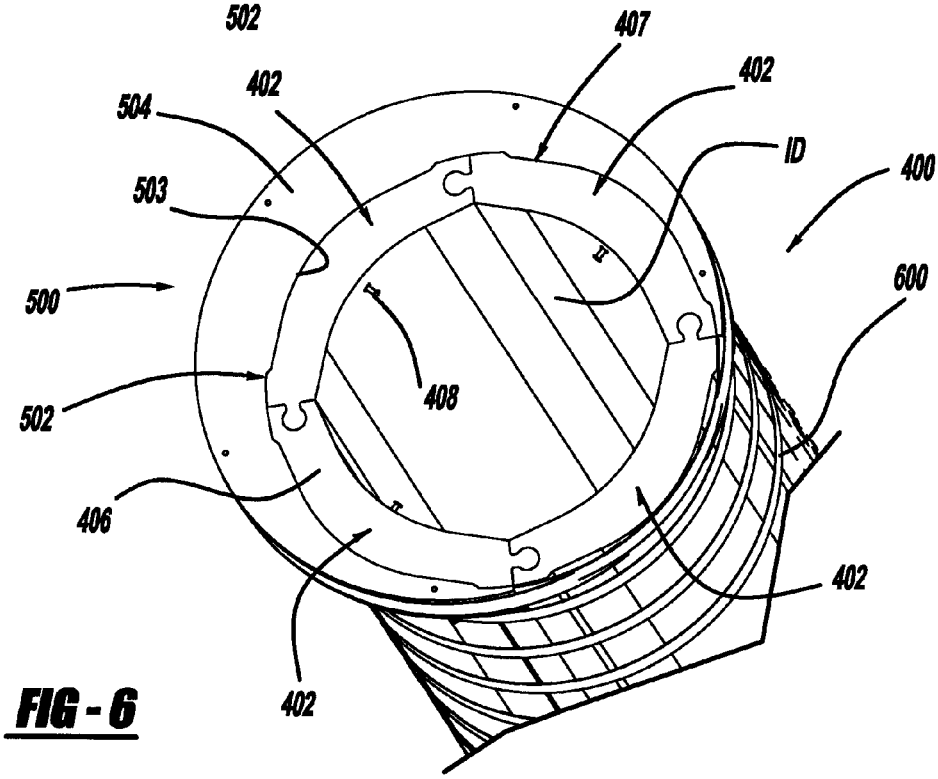
FIG. 6 is a partial bottom view of the bottom portion of the lower vertical form system depicted in FIGS. 4 and 5, in accordance with a sixth embodiment of the present invention.
Figure 7:
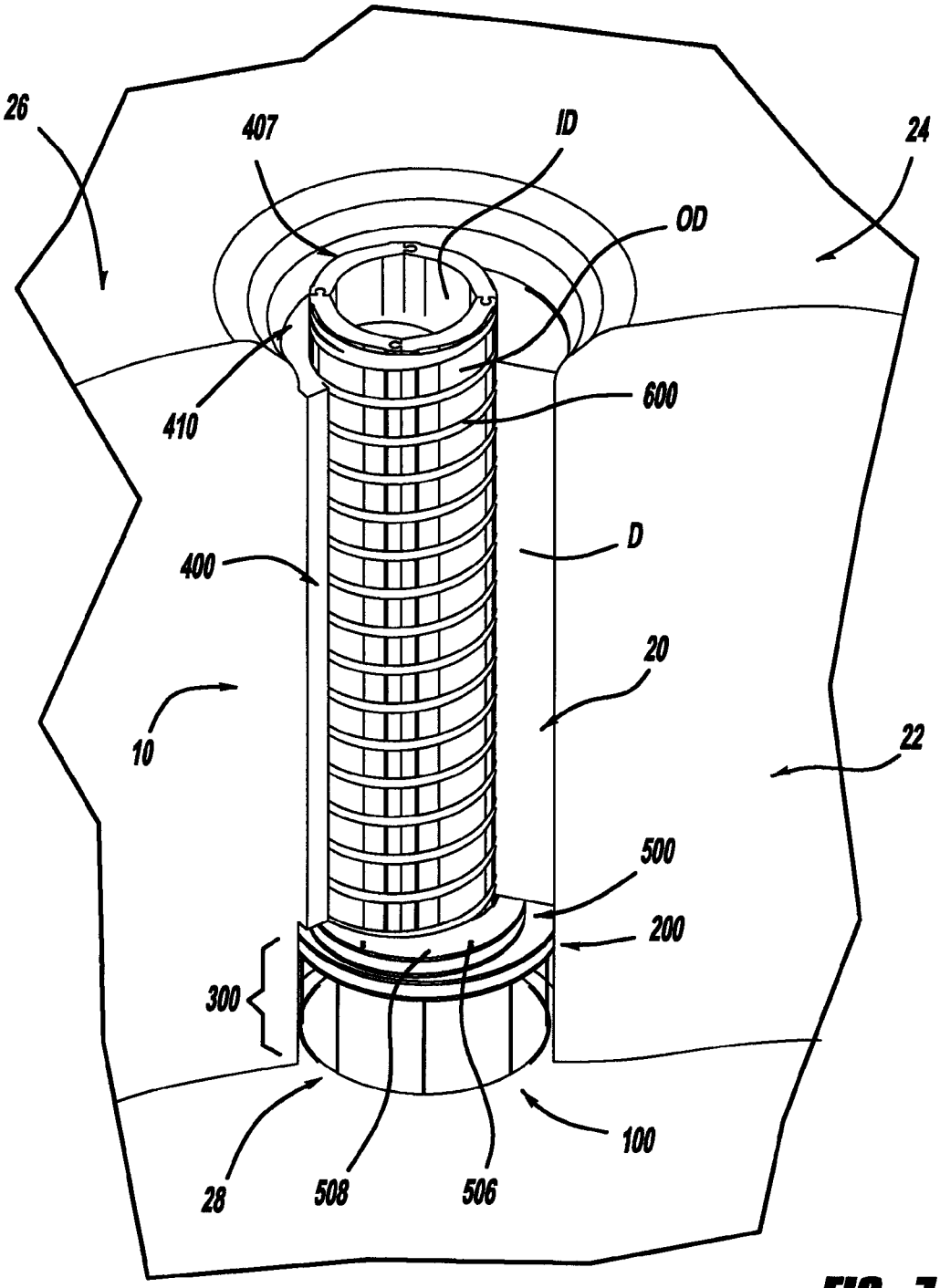
FIG. 7 is a perspective view of the lower vertical form system disposed on the base foam ring, which in turn is disposed on the wire support member, in situ in an earthen hole, in accordance with a seventh embodiment of the present invention.

Referring specifically to FIGS. 1-3, a wire support cage member 100 is intended to be placed into the earthen hole 20, such that it rests substantially levelly on the floor 28 thereof. The wire support cage member 100 can be formed in various configurations such that it defines variable heights, for example, from several inches to several feet, depending on the particular size of the concrete column or footing 30 required for the application. The wire support cage member 100 can be formed of many different materials (e.g., metals, plastics and/or the like); however, because it is intended to function as a support member, the wire support cage member 100 should be able to at least temporarily support the weights/loads of the other components of the form system 10 to be described herein.

The wire support cage member 100 includes a lower ring member 102, an upper ring member 104, and a plurality of spike members 106 fastened (e.g., welded) thereto such that the lower ring member 102 and the upper ring member 104 are substantially fixedly secured in a spaced and opposed configuration with respect to one another. The spike members 106 include pointed end portions 108 that extend above the upper ring member 104, the purpose of which will be explained herein.

As noted, the wire support cage member 100 can be set into the earthen hole 20. However, before placement occurs, a base foam ring member 200 having an area defining an offset center hole 202, a lower face 204, and an upper face 206, can be attached to the wire support cage member 100 to form a support assembly 300. The base foam ring member 200 can be comprised of any number of materials, including foams of course.

By way of a non-limiting example, the lower face 204 of the base foam ring member 200 can be pushed down onto the pointed end portions 108 of the spike member 106 such that the base foam ring member 200 can be held substantially firmly in place relative to the wire support cage member 100. Without being bound to a particular theory of the operation of the present invention, the use of an eccentrically formed base foam ring member 200, e.g., one having an offset center hole 202, as opposed to a centered center hole, is intended to facilitate the positioning and alignment of the other components of the form system 10, to be described herein.

The positioning of the support assembly 300 in the earthen hole 20 can be accomplished in any number of ways. However, the support assembly 300 should be placed in the earthen hole 20 such that the offset center hole 202 can be directly in line with the axial center of the proposed concrete column or footing 30. By way of a non-limiting example, the axial center of the concrete column or footing 30 can be taken from a string line set up to represent the building's or structure's column centerlines.

Referring specifically to FIGS. 4-7, the support assembly 300 is intended to provide adequate support for a lower vertical form system 400.

In accordance with one aspect of the present invention, the lower vertical form system 400 includes a plurality (e.g. four, although less than or more than this number are suitable for use with the present invention) of interlocking (e.g., via a tongue and groove arrangement and/or the like) sections 402 and an offset disk member 500 operably associated with a lower portion 404 of the lower vertical form system 400. By way of a non-limiting example, the offset disk member 500 can be substantially co-planar with a bottom surface 406 of the lower vertical form system 400. The offset disk member 500 can be comprised of any number of materials, such as but not limited to foam, wood, metals, plastics, and/or the like.

The interlocking sections 402 can be comprised of any number of materials (e.g., foam, wood, metal, plastics, and/or the like) and can be formed in variable lengths depending on the particular application required. When the interlocking sections 402 are brought into engagement with one another, the lower vertical form system 400 can be formed. When assembled, the interlocking sections 402 form a cylinder 407 having an outside face or diameter OD and an inside face or diameter ID appropriately sized for the load of the proposed concrete column or footing 30. For added stability, the thus assembled lower vertical form system 400 can be spirally wrapped with an adhesive or filament tape 600 and/or the like.

As previously described, an offset disk member 500 can be fastened to one end, e.g., the lower portion 404, of the lower vertical form system 400. The offset disk member 500 includes an area defining an offset hole 502 (including an inner face 503) that the lower vertical form system 400 fits into, such that the bottom face 504 of the offset disk member 500 can be substantially coplanar with the bottom surface 406 of the lower vertical form system 400. Fasteners 408 (e.g., nails, screws, bolts and/or the like) are then placed (e.g., pushed) through the inner face ID of the lower vertical form system 400 into the offset disk member 500, thus securing the offset disk member 500 to the lower vertical form system 400. Optionally, the filament tape 600 can also be used to secure the offset disk member 500 to the lower vertical form system 400. Additional fasteners 506 (e.g., nails, screws, bolts and/or the like) are then fastened to the upper face 508 of the offset disk member 500, such that the fasteners 506 only extend through the thickness of the offset disk member 500, i.e., they do not extend through the bottom face 504 of the offset disk member 500 at this time.

Once the lower vertical form system 400, with the attached offset disk member 500 is assembled, as described above, it is then placed in the earthen hole 20 on top of the support assembly 300, such that the bottom face 504 of the offset disk member 500 and/or the bottom surface 406 of the lower vertical form system 400 are in abutting relationship with the upper face 206 of the base foam ring member 200. The exact orientation of the bottom face 504 of the offset disk member 500 and/or the bottom surface 406 of the lower vertical form system 400 with the upper face 206 of the base foam ring member 200 is not though to be critical to the success of the present invention, provided that the lower vertical form system 400 is properly supported by the support assembly 300 and that the lower vertical form system 400 can be relatively easily positioned and/or repositioned relative to the support assembly 300. In this manner, the respective offset natures of the offset disk member 500 and the base foam ring member 200 add to the stability of the form system 10, especially when the lower vertical form system 400 is being repositioned in the earthen hole 20.

By way of a non-limiting example, the lower vertical form system 400 can then be slideably rotated on the support assembly 300 so as to align the central vertical axis of the lower vertical form system 400 with the central vertical axis of the offset hole 202 of the base foam ring member 200. The lower vertical form system 400 can then be plumbed and positioned, in any suitable manner, in relation to any layout strings and/or the like.

Once aligned, the lower vertical form system 400 can be secured to the base foam ring member 200 with fasteners 506 which are driven through the bottom face 504 of the offset disk member 500 into the upper face 204 of the base foam ring member 200. By way of a non-limiting example, when the lower vertical form system 400 is in the correct position, a rod or other suitable tool (not shown) can be inserted into the earthen hole 20 and the fasteners 506 in the offset disk member 500 are pushed downwardly into the base foam ring member 200, thus holding the lower vertical form system 400 in place.

The earthen hole 20 can then be backfilled (i.e., the space between the wall of the earthen hole 20 and the outer face OD of the lower vertical form system 400 can be backfilled), e.g., with dirt D, so as to rigidly secure the form system 10 in place such that it would be difficult, if not impossible, to move the form system 10, or any component thereof. Once secured in this manner, an upper portion 410 of the lower vertical form system 400 can then be cut to a determined grade, e.g., with a saw, knife, laser, and/or the like.

Figure 8:
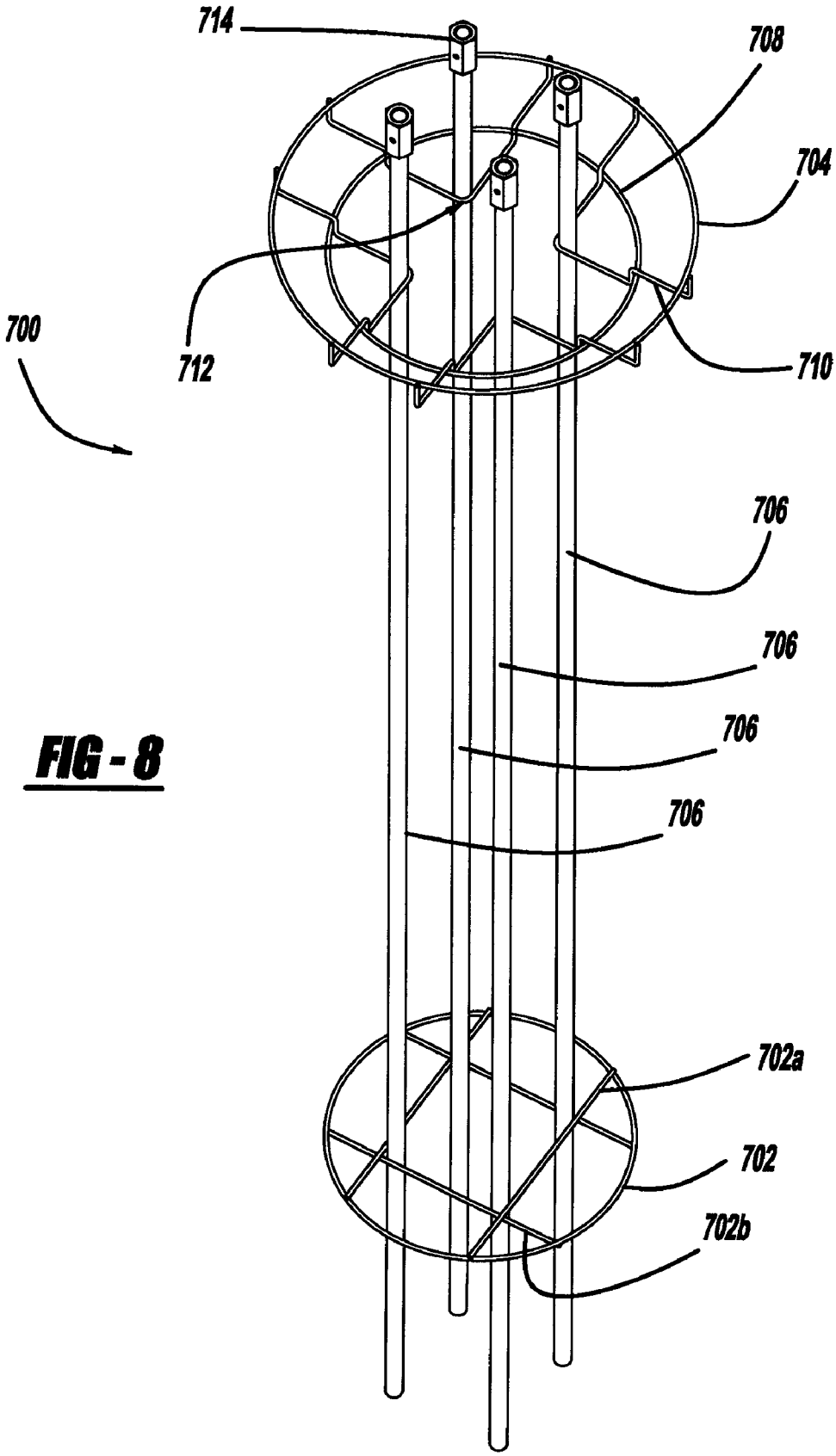
FIG. 8 is a perspective view of a reinforcing assembly, in accordance with an eighth embodiment of the present invention.
Figure 9:
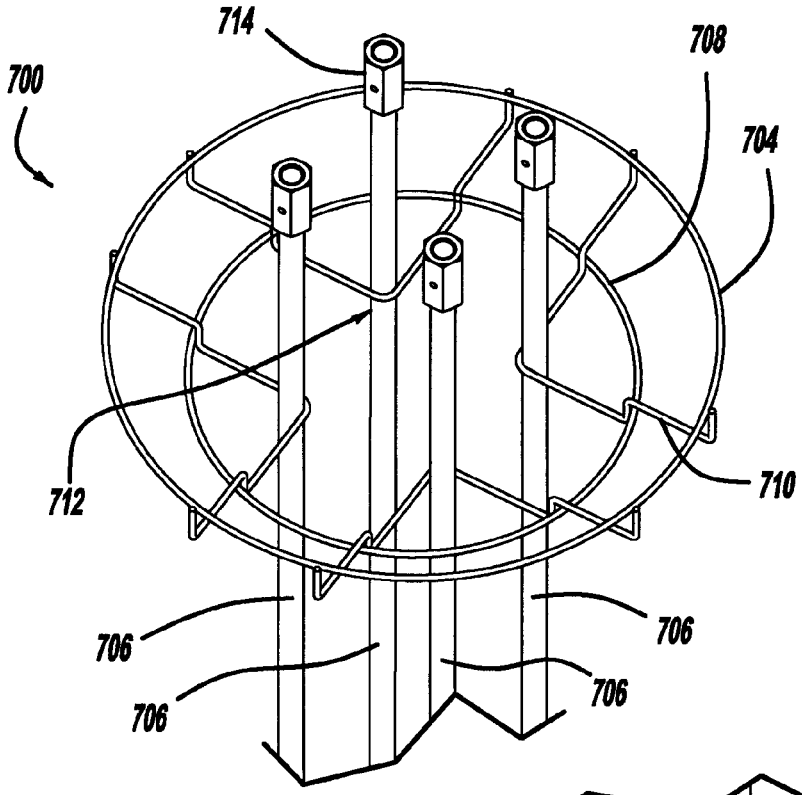
FIG. 9 is a partial perspective view of a top portion of the reinforcing assembly depicted in FIG. 8, in accordance with a ninth embodiment of the present invention.
Figure 10:
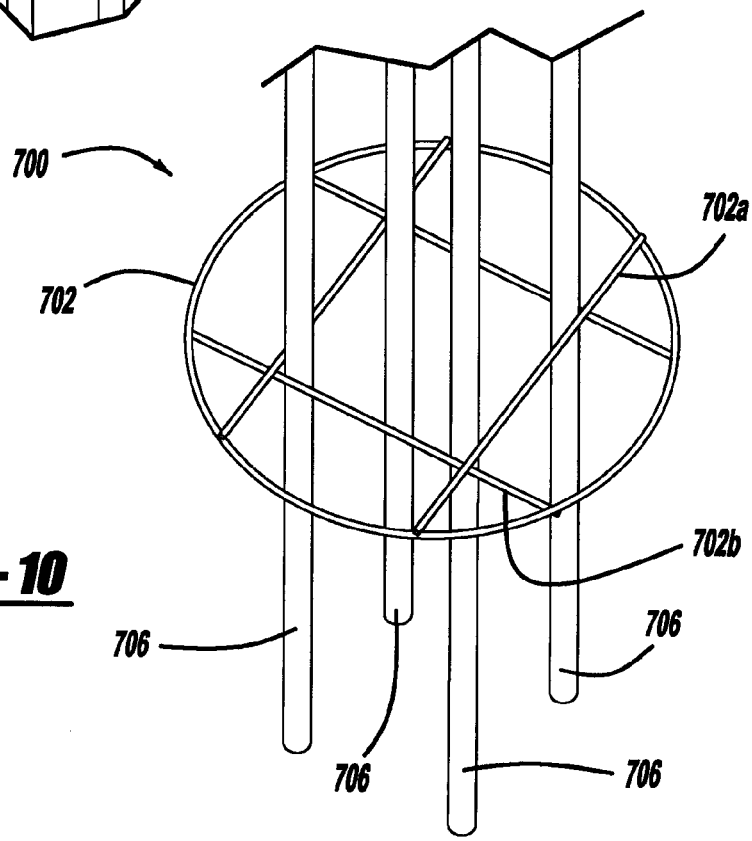
FIG. 10 is a partial perspective view of a bottom portion of the reinforcing assembly depicted in FIG. 8, in accordance with a tenth embodiment of the present invention.

Referring to FIGS. 8-10, a reinforcing assembly 700 can be employed in conjunction with the form system 10 of the present invention. By way of a non-limiting example, the reinforcing assembly 700 can provide reinforcement to the concrete column or footing 30 that is to be formed. The reinforcing assembly 700 can be comprised of any number of materials, such as but not limited to metals. By way of a non-limiting example, the reinforcing assembly 700 can be comprised of #5 rebar; however, it should be appreciated that many other different types, styles, and gauges of metallic materials can be employed in the practice of the present invention.

In accordance with one aspect of the present invention, the reinforcing assembly 700 includes a lower ring member 702, a spaced and opposed upper ring member 704, and a plurality of reinforcement members 706 extending from and through either or both of the lower ring member 702 and/or upper ring member 704. By way of a non-limiting example, the plurality of reinforcement members 706 can be fastened (e.g., welded) to a surface of the lower ring member 702, such as bisecting cross members 702*a*, 702*b*, respectively. The upper ring member 704 can include an inner ring member 708 interconnected by a plurality of loop members 710, a surface of which can be fastened (e.g., welded) to a surface of the upper ring member 704 and/or the inner ring member 708. The reinforcement members 706 can rest upon the vertices 712 of the loop members 710 or can alternatively be fastened (e.g., welded) to a surface of the vertices 712. The ends of the reinforcement members 706 can be provided with attachment members 714, e.g., for facilitating attachment of additional components of the form system 10.

Figure 11:
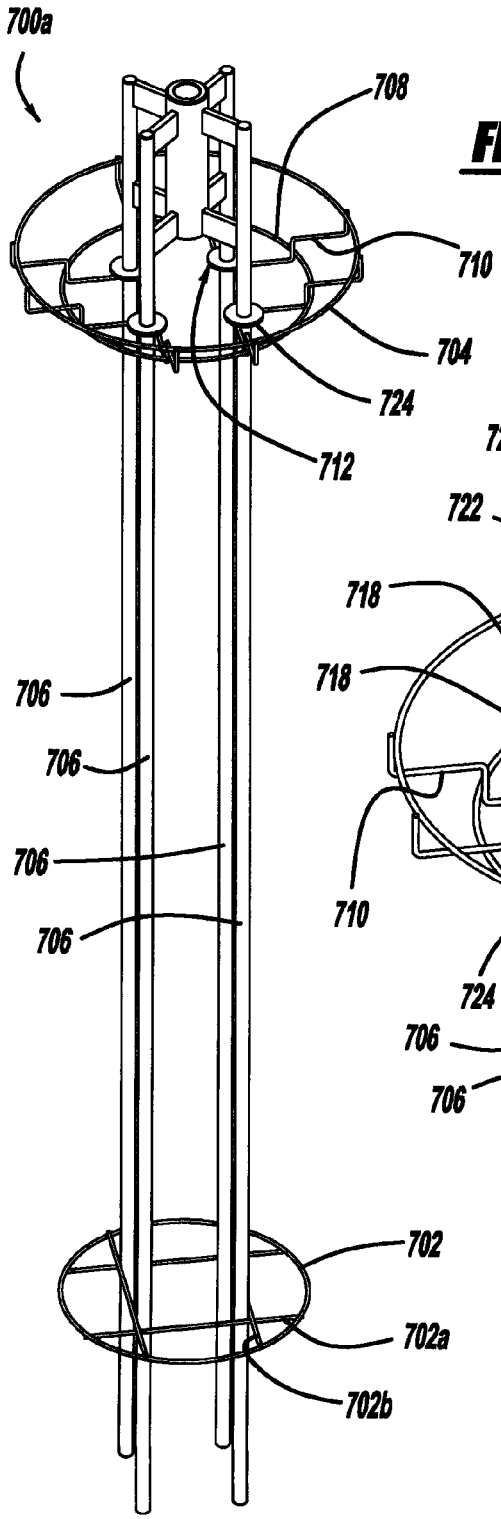
FIG. 11 is a perspective view of an alternative reinforcing assembly, in accordance with an eleventh embodiment of the present invention.
Figure 12:
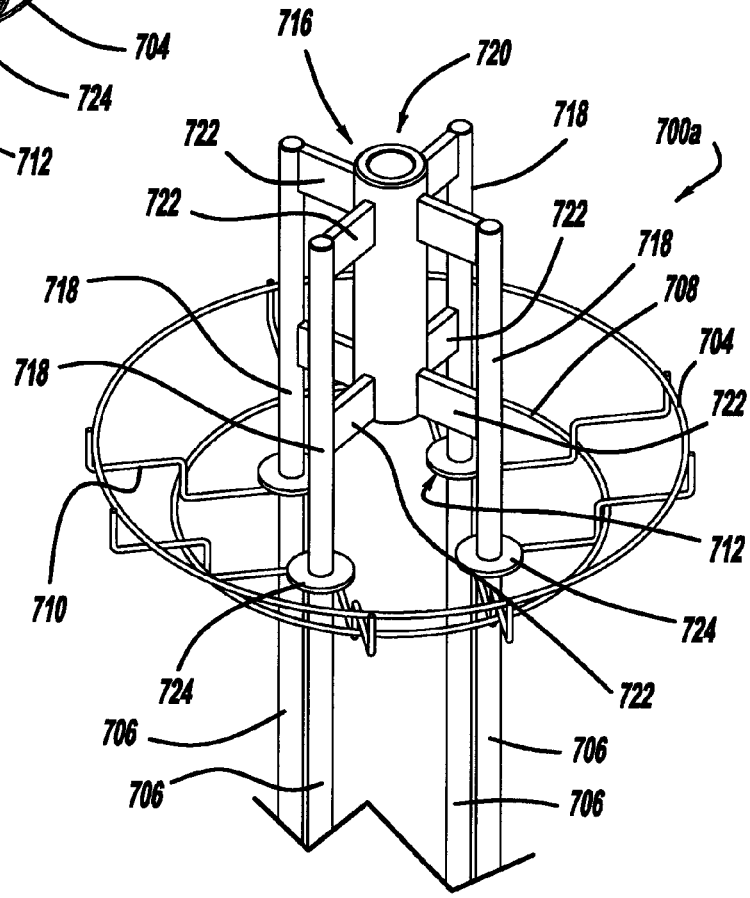
FIG. 12 is a partial perspective view of a top portion of the alternative reinforcing assembly depicted in FIG. 11, in accordance with a twelfth embodiment of the present invention.
Figure 13:
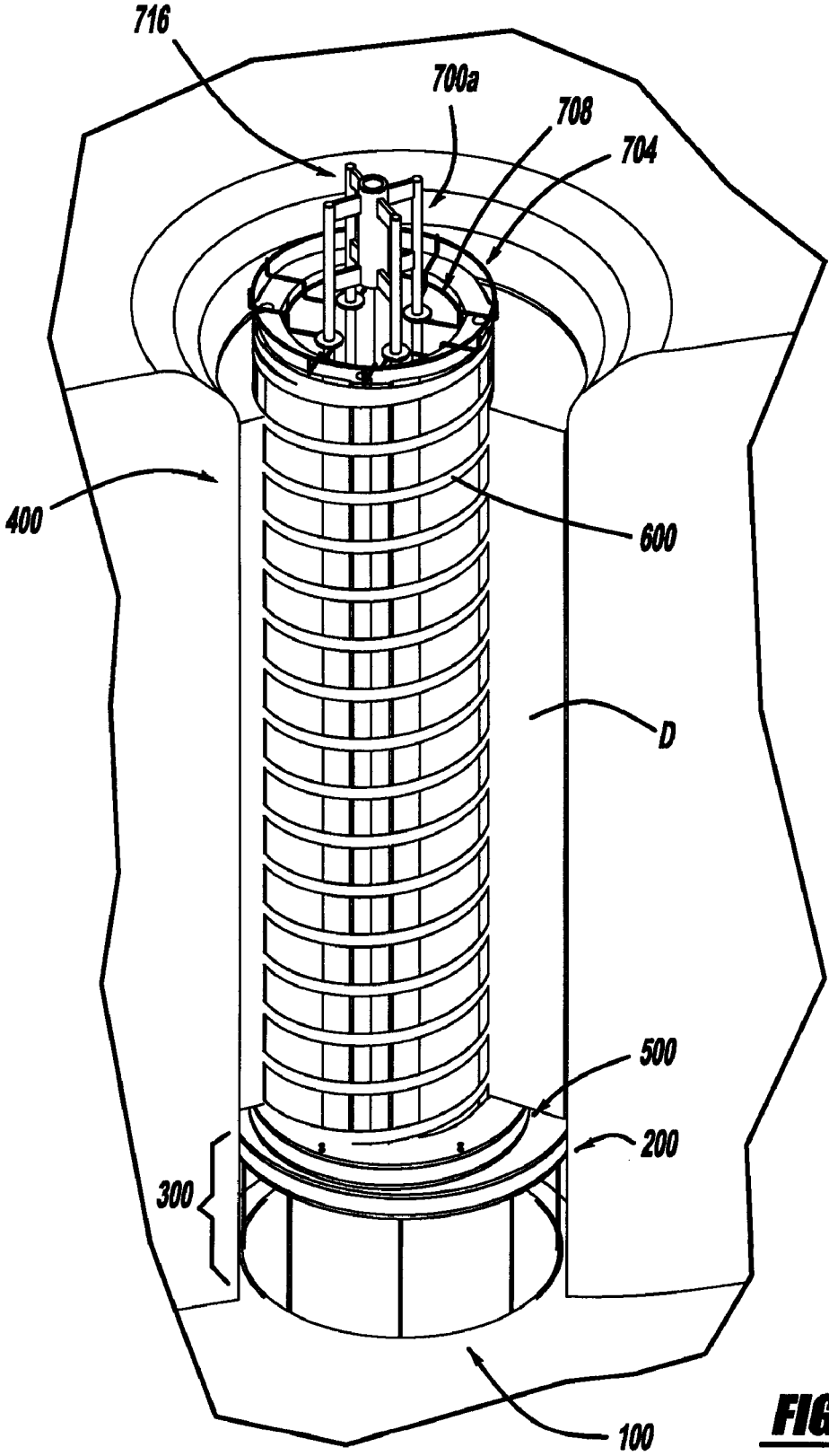
FIG. 13 is a perspective view of the alternative reinforcing assembly disposed within the lower vertical form system depicted in FIG. 7, in situ in an earthen hole, in accordance with a thirteenth embodiment of the present invention.
Figure 14:
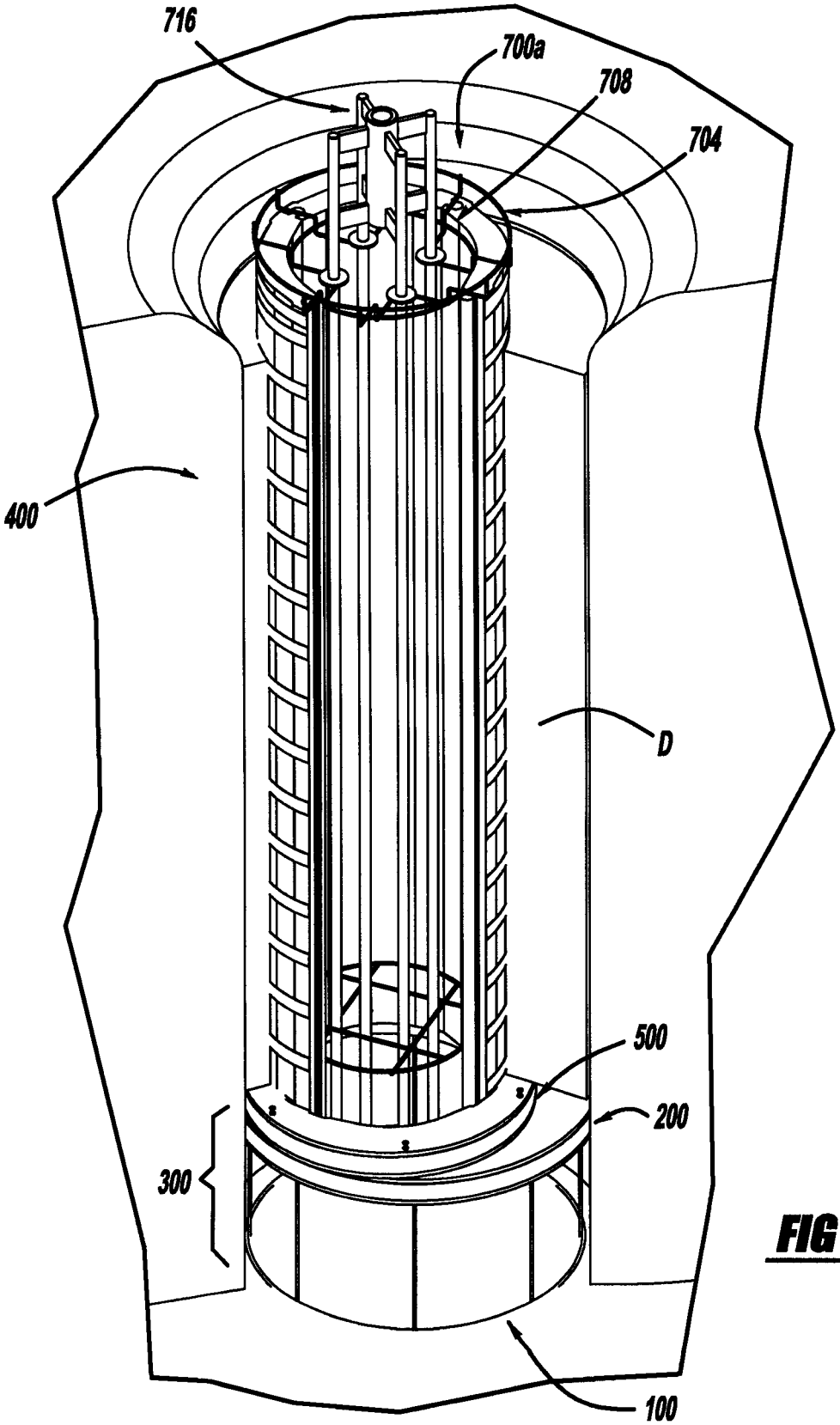
FIG. 14 is a partial broken away view of the alternative reinforcing assembly disposed within the lower vertical form system depicted in FIG. 13, in situ in an earthen hole, in accordance with a fourteenth embodiment of the present invention.
Figure 15:
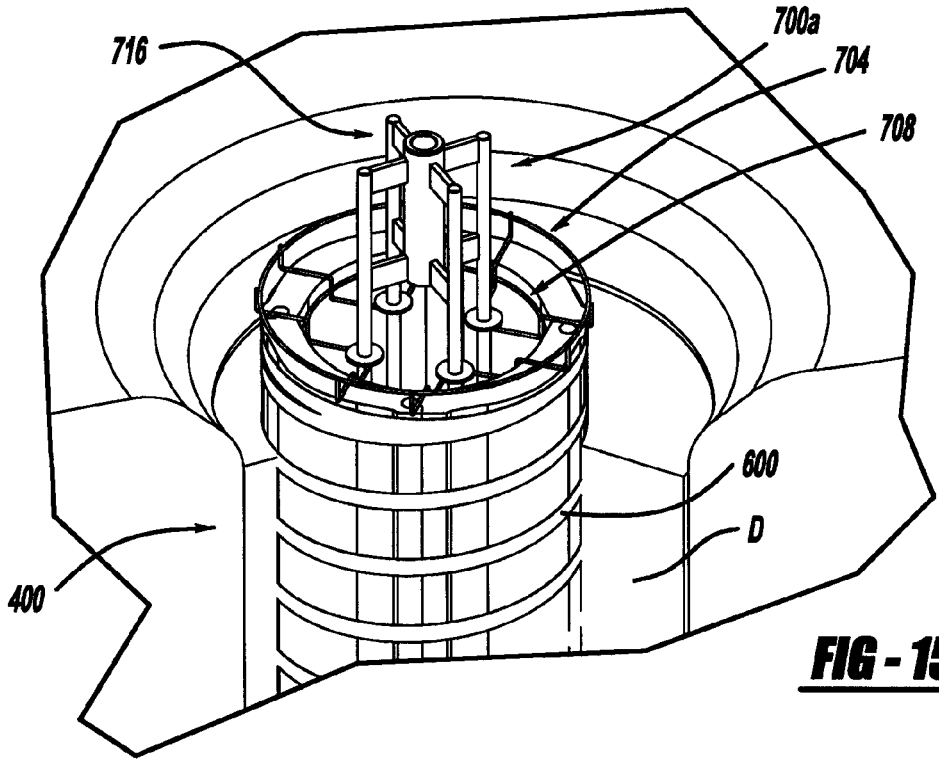
FIG. 15 is a partial perspective view of a top portion of the alternative reinforcing assembly disposed in the lower vertical form system depicted in FIG. 14, in accordance with a fifteenth embodiment of the present invention.
Figure 16:
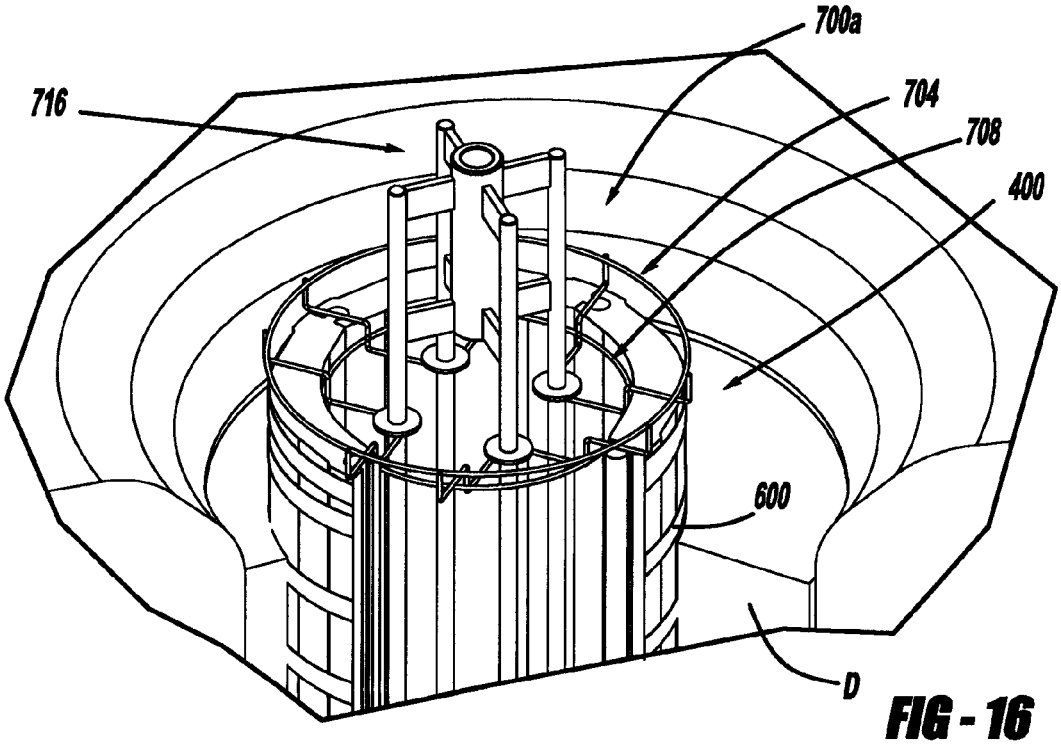
FIG. 16 is a partial broken away view of the top portion of the alternative reinforcing assembly disposed in the lower vertical form system depicted in FIG. 14, in accordance with a sixteenth embodiment of the present invention.
Figure 17:
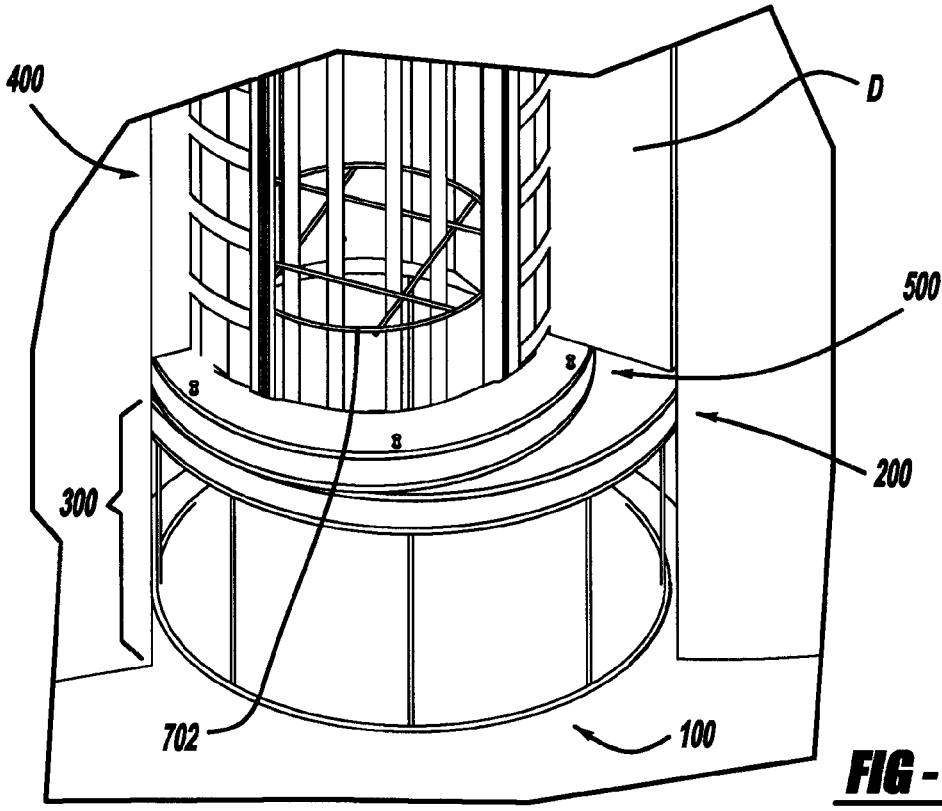
FIG. 17 is a partial broken away view of a bottom portion of the alternative reinforcing assembly disposed in the lower vertical form system depicted in FIG. 14, in accordance with a seventeenth embodiment of the present invention.

Referring specifically to FIGS. 11-12, an alternative reinforcing assembly 700*a* includes a column bracket member 716. The intended purpose of the column bracket member 716 is to mate with the ends, specifically the attachment members 714, of the reinforcement members 706 so as to add stability and rigidity to the reinforcing assembly 700*a*. The column bracket 716 includes four generally cylindrical members 718 that are connected to a central cylindrical member 720 via a plurality of cross members 722. The cylindrical members 718 can telescopically mate with the attachment members 714 of the reinforcing members 706, e.g., the cylindrical members 718 can include an open end having an associated bore or cavity. A plurality of washer members 724 can be provided about the attachment members 714 such that they engage a surface of the vertices 712, which in turn can provide support to the cylindrical members 718 resting thereupon.

Referring specifically to FIGS. 13-17, once the lower vertical form system 400 has been properly positioned and its length has been cut to grade, the reinforcing assembly 700*a* can be inserted into the lower vertical form system 400 such that the column bracket 716 extends above the upper edge of the lower vertical form system 400. Additionally, the diameter of the reinforcing assembly 700*a* can be sized so as to abut against or nearly abut against the inner face ID of the lower vertical form system 400 such that there is not excessive room between the exterior surface of the reinforcing assembly 700*a* and the inner face ID of the lower vertical form system 400. The upper ring member 704 can function as a top positioning cage of the reinforcing assembly 700*a* and centers and holds the reinforcing assembly 700*a* at the right height relative to the upper edge of the lower vertical form system 400.

Figure 18:
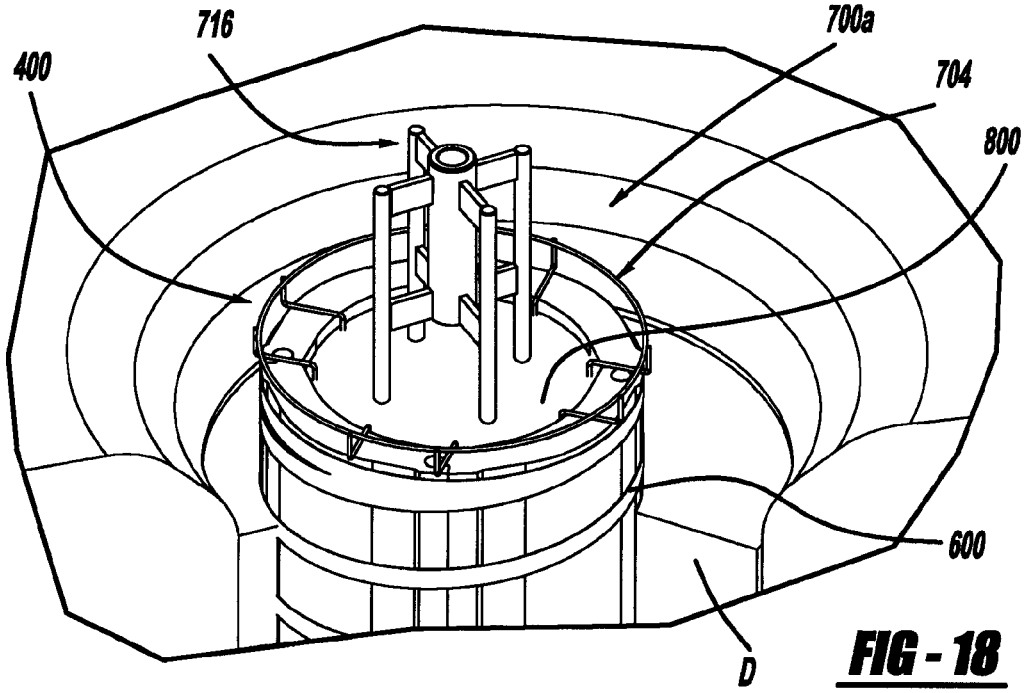
FIG. 18 is a perspective view of the top portion of the alternative reinforcing assembly disposed in the lower vertical form system depicted in FIG. 14 after concrete has been introduced into the vertical form system, in accordance with an eighteenth embodiment of the present invention.
Figure 19:
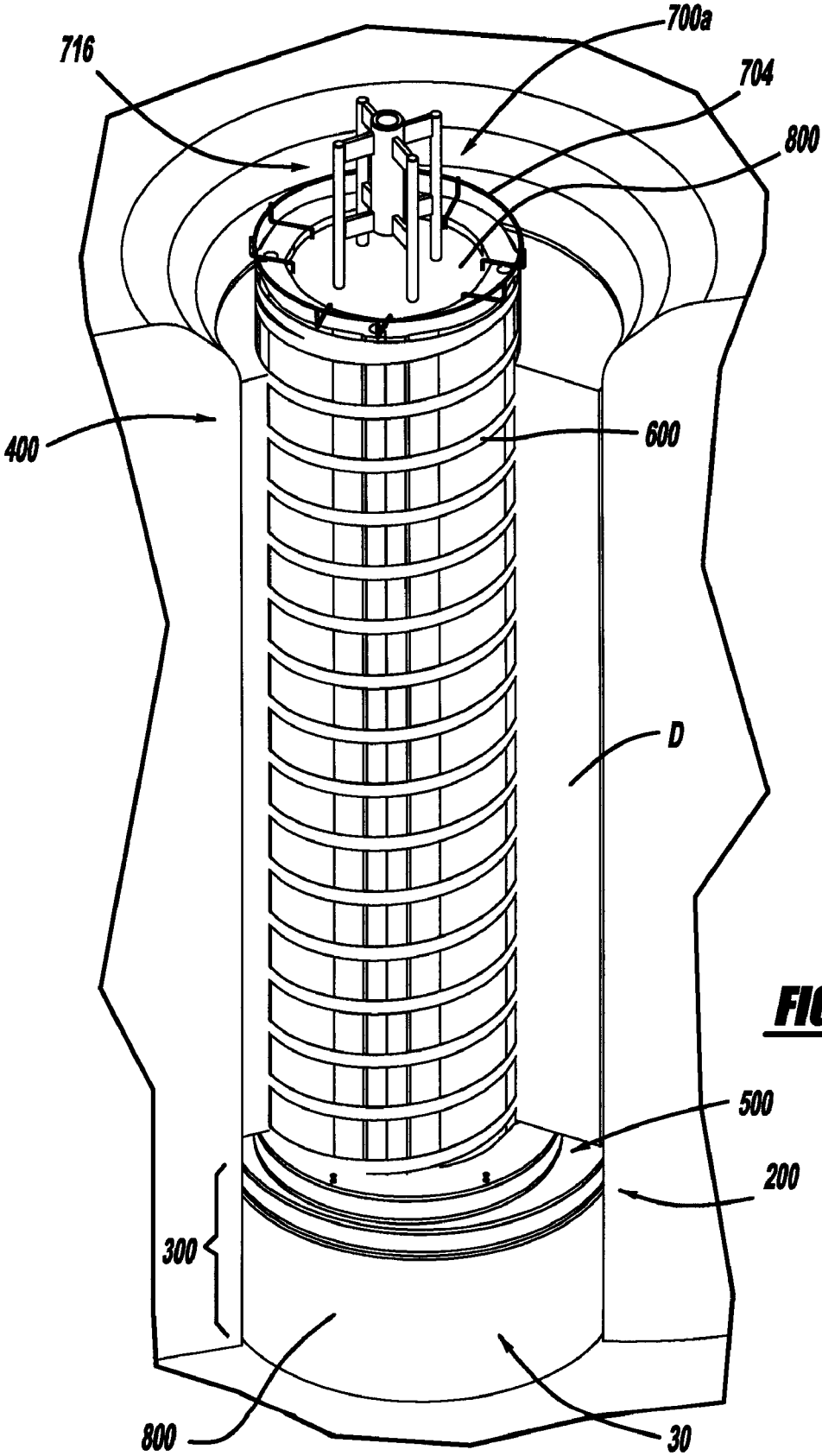
FIG. 19 is a perspective view of the alternative reinforcing assembly disposed in the lower vertical form system depicted in FIG. 14 after concrete has been introduced into the vertical form system, in situ in an earthen hole, in accordance with a nineteenth embodiment of the present invention.
Figure 20:
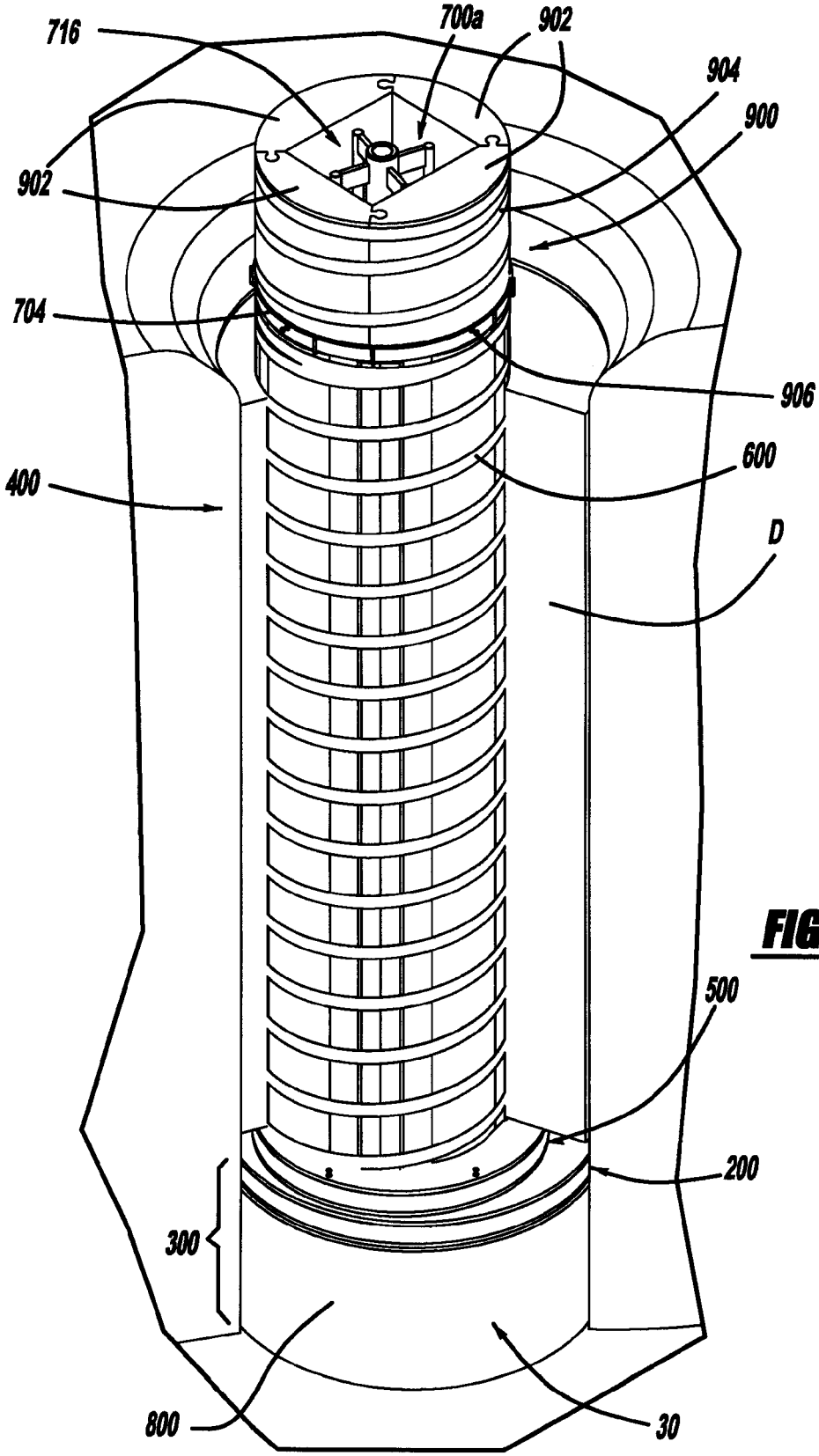
FIG. 20 is a perspective view of an upper vertical form system disposed on top of the lower vertical form system depicted in FIG. 19, in situ in an earthen hole, in accordance with a twentieth embodiment of the present invention.
Figure 21:
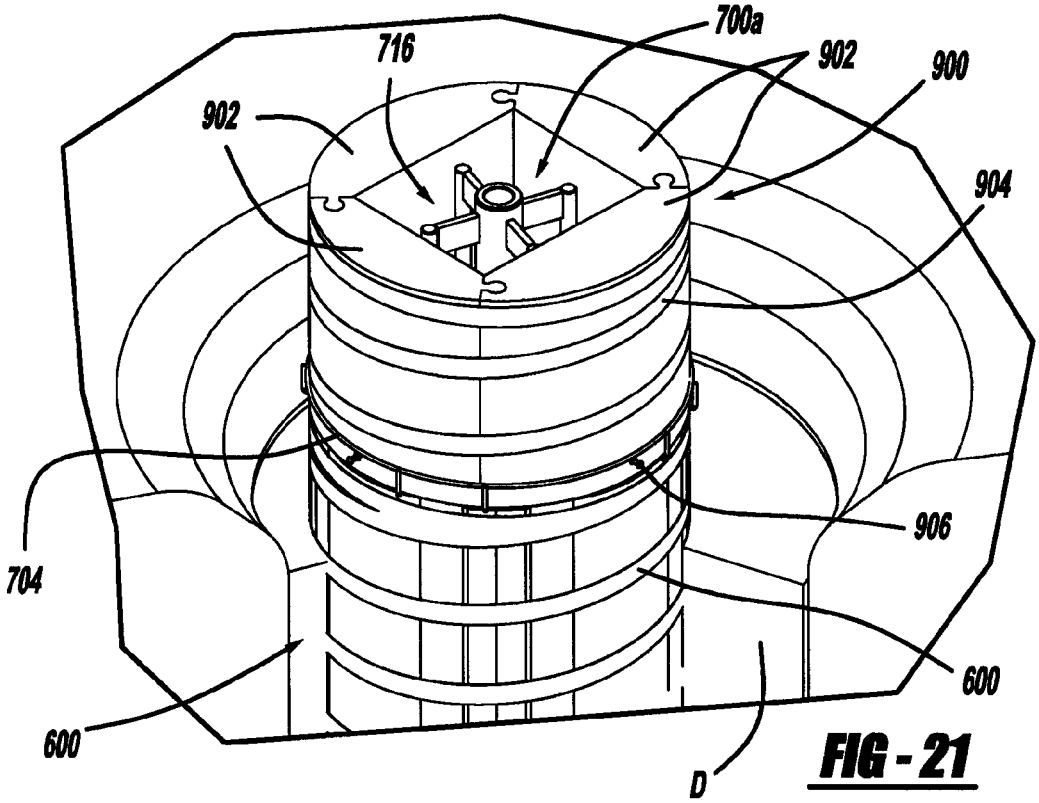
FIG. 21 is a partial perspective view of the upper vertical form system disposed on top of the lower vertical form system depicted in FIG. 19, in accordance with a twenty-first embodiment of the present invention.
Figure 22:
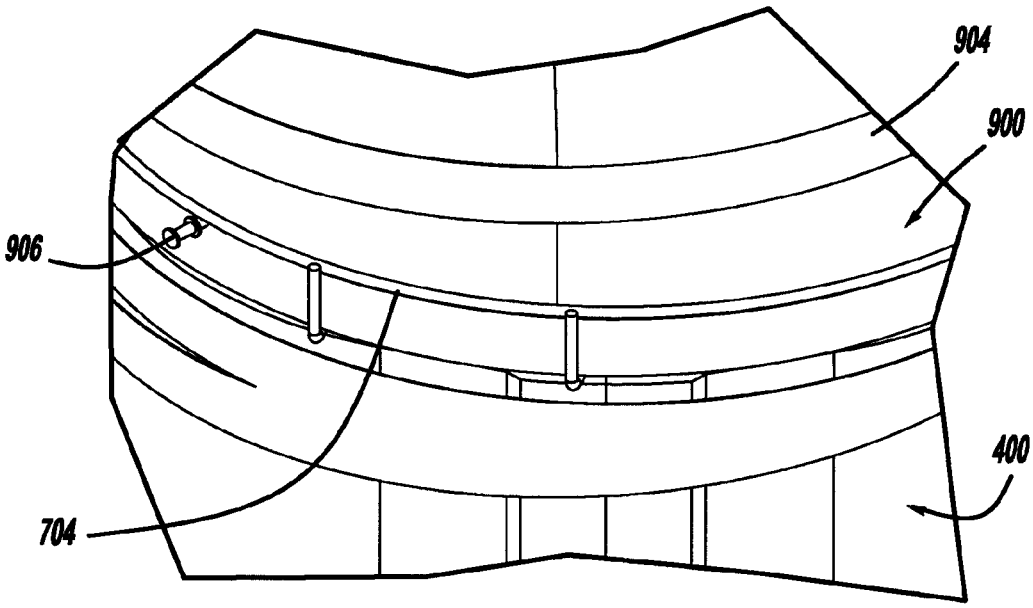
FIG. 22 is a partial perspective view of a detailed section of the upper vertical form system disposed on top of the lower vertical form system depicted in FIG. 19, in accordance with a twenty-second embodiment of the present invention.
Figure 23:
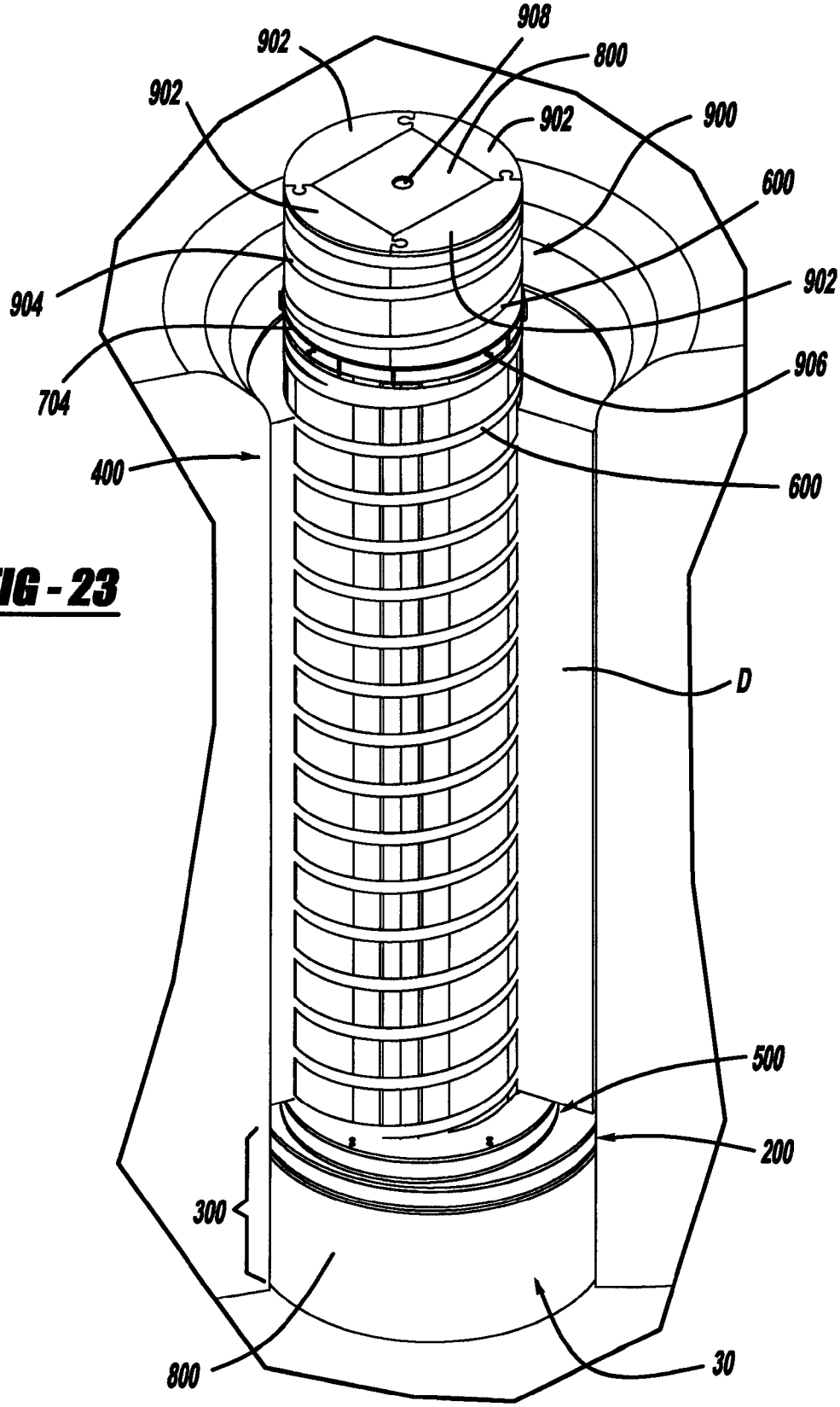
FIG. 23 is a perspective view of the upper vertical form system disposed on top of the lower vertical form system depicted in FIG. 19 after concrete has been introduced into the upper vertical form system, in situ in an earthen hole, in accordance with a twenty-third embodiment of the present invention.
Figure 24:
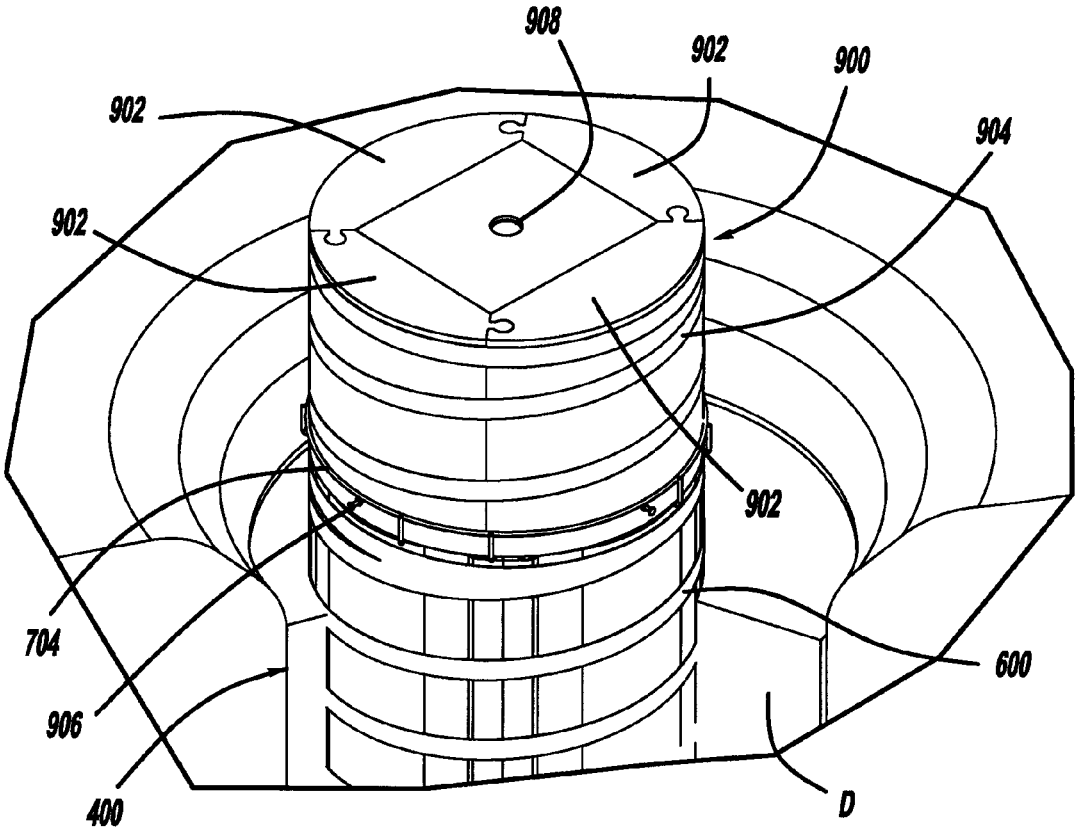
FIG. 24 is a partial perspective view of the upper vertical form system disposed on top of the lower vertical form system depicted in FIG. 19 after concrete has been introduced into the upper vertical form system, in accordance with a twenty-fourth embodiment of the present invention.

Referring specifically to FIGS. 18-19, a sufficient amount of concrete 800 (e.g., in the form of a liquid, slurry and/or the like) can then be poured into the lower vertical form system 400 and filled close to the upper edge of the lower vertical form system 400. The concrete 800 preferably infiltrates all the way down the lower vertical form system 400 to completely fill the lower portion of the earthen hole 20, especially in the area of the support assembly 300. In this manner, the lower portion of the concrete column or footing 30 can be formed.

Referring specifically to FIGS. 20-24, an upper vertical form system 900 includes a plurality of interlocking sections 902 (e.g., employing a tongue and groove arrangement) that are optionally taped together (e.g., using adhesive or filament tape 904) for added stability and rigidity. The upper vertical form system 900 can then be placed on top of the lower vertical form system 400. The upper vertical form system 900 can be held in place by the upper ring member 704 (e.g., the top positioning cage portion thereof).

As with the lower vertical form system 400, it is important that the upper vertical form system 900 is properly plumbed and aligned. By way of a non-limiting example, the upper vertical form system 900 can be lined up with any layout strings and squared to the associated building or structure. Fasteners 906 (e.g., nails, screws, bolts, and/or the like) are pushed into the surface of the upper vertical form system 900 under the outside wire 704*a* of the upper ring member 704 so as to keep the upper vertical form system 900 in place. One or more optional plug caps (not shown) can be inserted into one or more attaching points 908 so as to keep them clean and free from any poured concrete 800. A sufficient amount of additional concrete 800 (e.g., in the form of a liquid, slurry and/or the like) can then be poured into the upper vertical form system 900 and filled close to the upper edge of the upper vertical form system 900. In this manner, the upper portion of the concrete column or footing 30 can be formed.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A form system for forming a structural element in situ in an earthen hole, comprising:

a support member for placement within the earthen hole;

an eccentric disk member disposed on top of the support member and defining an offset aperture with the support member configured for supporting the eccentric disk member in spaced relationship relative to a floor surface of the earthen hole;

a lower vertical form system disposed on top of the eccentric disk member, wherein the lower vertical form system includes a wall member having an outer face and an inner face, wherein the wall member defines a throughbore extending from a first end of the lower vertical form system to a second end of the lower vertical form system and wherein the throughbore and the offset aperture at least partially overlap to permit a curable material introduced into an open and upper end of the lower vertical form system to flow by gravity into and through the throughbore and through the offset aperture to envelope the support member in situ; and an upper vertical form system disposed on a surface of the lower vertical form system, wherein the upper vertical form system includes a wall member having an outer face and an inner face, wherein the wall member defines a throughbore extending from a first end of the upper vertical form system to a second end of the upper vertical form system, wherein at least a portion of the throughbore of the lower vertical form system and the throughbore of the upper vertical form system are coaxially aligned to permit the curable material to pass therethrough.

2. The invention according to claim 1, wherein either the lower vertical form system or the upper vertical form system includes a plurality of interlocking wall portions operable to form a substantially cylindrical member.

3. The invention according to claim 1, further comprising a reinforcement assembly disposed in either the lower vertical support system or the upper vertical support system.

4. The invention according to claim 3, wherein the reinforcement assembly includes a first portion and a second portion disposed on the first portion, wherein the first portion comprises a plurality of substantially elongated reinforcement members in fixed relationship to one another, wherein the second portion includes a bracket member fastened to an end portion of at least one of the reinforcement members.

5. The invention according to claim 3, wherein the support member comprises a cage member having a first end and a spaced and opposed second end defining a throughbore therebetween.

6. The invention according to claim 3, wherein the lower vertical form system is disposed entirely within the earthen hole and fully recessed below a grade surface thereof and the upper vertical form system is located above a grade surface of the earthen hole.

7. A method of forming a structural element in situ in an earthen hole with a form system including a support member, an eccentric disk member defining an offset aperture formed therein, and a lower vertical form system having a wall defining a throughbore extending between a first end and a second end of the lower vertical form system, said method comprising the steps of:

excavating the earthen hole to define a floor surface;

positioning the support member on the floor surface of the earthen hole;

positioning the disk member on top of the support member in spaced relationship to the floor surface of the earthen hole; and positioning the lower vertical form system on top of the disk member at least partially within the earthen hole with the offset aperture at least partially aligned with the throughbore; and, flowing a curable material into the throughbore after the form system is positioned within the earthen hole such that the curable material flows through the throughbore and the offset aperture to envelope the support member within the earthen hole.

8. The method according to claim 7, further comprising providing a second disk member, wherein the second disk member is disposed about either the first end or the second end of the wall member of the lower vertical form system, wherein the second disk member includes an area defining a second offset aperture formed therein, wherein the second disk member and the disk member are operable to be brought into abutting engagement such that at least a portion of the aperture of the disk member and the second aperture of the second disk member are coaxially aligned to permit the curable material to flow therethrough.

9. The method according to claim 7, further comprising providing an upper vertical form system, wherein the upper vertical form system is disposed on a surface of the lower vertical form system, wherein the upper vertical form system includes a wall member having an outer face and an inner face, wherein the wall member defines a throughbore extending from a first end of the upper vertical form system to a second end of the upper vertical form system, wherein at least a portion of the throughbore of the lower vertical form system and the throughbore of the upper vertical form system are coaxially aligned.

10. The method according to claim 9, wherein either the lower vertical form system or the upper vertical form system includes a plurality of interlocking wall portions operable to form a substantially cylindrical member.

11. The method according to claim 9, further comprising providing a reinforcement assembly, wherein the reinforcement assembly is disposed in either the lower vertical support system or the upper vertical support system.

12. The method according to claim 11, wherein the reinforcement assembly includes a first portion and a second portion disposed on the first portion, wherein the first portion comprises a plurality of substantially elongated reinforcement members in fixed relationship to one another, wherein the second portion includes a bracket member fastened to an end portion of at least one of the reinforcement members.

13. The method according to claim 11, wherein the support member comprises a cage member having a first end and a spaced and opposed second end defining a throughbore therebetween.

14. The method according to claim 11, wherein the lower vertical form system is disposed entirely within the earthen hole and fully recessed below a grade surface thereof and the upper vertical form system is located above a grade surface of the earthen hole.

15. The invention according to claim 1 wherein the eccentric disk member and the lower vertical form system comprise a foam material for remaining in situ about the structural element after the structural element is formed.

16. A method according to claim 7 further comprising the step of backfilling the earthen hole around the form system after the form system is positioned in situ.

17. A method according to claim 16 wherein the step of backfilling the earthen hole around the form system is further defined as backfilling the earthen hole around the form system prior to flowing the curable material into the throughbore to form the structural element.

18. A method according to claim 7 wherein the eccentric disk element and the lower vertical form system comprise a foam material.

19. A method according to claim 18 further comprises the step of removing a portion of the lower vertical form system disposed above a grade surface of the earthen hole.

20. A method according to claim 18 wherein the form system includes a fastener and the method further comprises the step of pushing the fastener through the lower vertical form system and into the eccentric disk element after the eccentric disk element and the lower vertical form system are positioned in place to secure the lower vertical form system to the eccentric disk member.

21. A method according to claim 7 wherein the step of positioning the lower vertical form system on top of the eccentric disk member is further includes the step of slideably rotating the lower vertical form system relative to the eccentric disk member to concentrically align the throughbore along a centerline of the structural element.

22. A method of forming a structural element in situ in an earthen hole with a form system including a support member, an eccentric disk member defining an offset aperture formed therethrough, a second disk member defining a second offset aperture therethrough and a lower vertical form system having a wall defining a throughbore extending between a first end and a second end of the lower vertical form system, said method comprising the steps of:

excavating the earthen hole to define a floor surface and a diameter of the earthen hole;

positioning the support member on the floor surface of the earthen hole;

positioning the eccentric disk member on top of the support member in spaced relationship to the floor surface of the earthen hole, wherein the eccentric disk member includes a diameter substantially equal to the diameter of the earthen hole;

attaching the second disk member to one of the first end and the second end of the wall of the lower vertical form system;

disposing the lower vertical form system and the second disk member on top of the eccentric disk member with the lower vertical form system at least partially within the earthen hole positioning the lower vertical form system and the second disk member relative to the eccentric disk member such that the throughbore and the second offset aperture are at least partially aligned with the offset aperture of the eccentric disk member and such that the second disk member extends radially outward to cover any portion of the offset aperture of the eccentric disk member disposed radially outside the wall of the lower vertical form system; and flowing a curable material into the throughbore after the form system is positioned within the earthen hole such that the curable material flows through the throughbore and the offset aperture to envelope the support member within the earthen hole.

23. A method as set forth in claim 22 wherein the wall of the lower vertical form system defines a diameter and the step of positioning the lower vertical form system and the second disk member relative to the eccentric disk member is further defined as moving the lower vertical form system and the second disk member relative to the eccentric disk member laterally from a desired centerline of the structural element between a range defined by the difference between the diameter of the earthen hole and the diameter of the wall of the lower vertical form system.

24. A method as set forth in claim 23 wherein the step of positioning the lower vertical form system and the second disk member relative to the eccentric disk member is further defined as rotating the lower vertical form system and the second disk member about a longitudinal axis of the lower vertical form system relative to the eccentric disk member to cover any portion of the offset aperture of the eccentric disk member radially disposed outside the wall member of the lower vertical form system with the second disk member.

25. A method as set forth in claim 22 wherein the step of flowing a curable material into the throughbore is further defined as flowing a curable material into the throughbore and through the second offset aperture of the second disk member and the offset aperture of the eccentric disk member to form a footing having a diameter substantially equal to the diameter of the earthen hole and a height substantially equal to a distance the eccentric disk member is spaced from the floor surface of the earthen hole, and a structural column having an unobstructed cross section the full inner diameter of the wall of the lower vertical form system.

26. A method as set forth in claim 22 further comprising the step of backfilling the earthen hole around an outer periphery of the lower vertical form system prior to flowing the curable material into the throughbore.

27. A method as set forth in claim 22 further comprising the step of removing a portion of the lower vertical form system disposed above a pre-determined elevation.

28. A method as set forth in claim 22 further comprising the step of lowering structural reinforcements into the throughbore of the lower vertical form system.

29. A form system for forming a structural element in situ in an earthen hole, comprising:

a support member for placement within the earthen hole;

an eccentric disk member disposed on top of the support member and defining an offset aperture with the support member configured for supporting the eccentric disk member in spaced relationship relative to a floor surface of the earthen hole;

a lower vertical form system disposed on top of the eccentric disk member, wherein the lower vertical form system includes a wall member having an outer face and an inner face, wherein the wall member defines a throughbore extending from a first end of the lower vertical form system to a second end of the lower vertical form system and wherein the throughbore and the offset aperture at least partially overlap to permit a curable material introduced into an open and upper end of the lower vertical form system to flow by gravity into and through the throughbore and through the offset aperture to envelope the support member in situ; and a second disk member disposed about either the first end or the second end of the wall member of the lower vertical form system, wherein the second disk member includes an area defining a second offset aperture formed therein, wherein the second disk member and the eccentric disk member are operable to be brought into abutting engagement such that at least a portion of the aperture of the eccentric disk member and the second offset aperture of the second disk member are coaxially aligned and the second disk member covers a portion of the offset aperture of the eccentric disk member radially disposed outside the wall member.

30. The invention according to claim 29, further comprising an upper vertical form system disposed on a surface of the lower vertical form system, wherein the upper vertical form system includes a wall member having an outer face and an inner face, wherein the wall member defines a throughbore extending from a first end of the upper vertical form system to a second end of the upper vertical form system, wherein at least a portion of the throughbore of the lower vertical form system and the throughbore of the upper vertical form system are coaxially aligned to permit the curable material to pass therethrough.

31. The invention according to claim 30, wherein either the lower vertical form system or the upper vertical form system includes a plurality of interlocking wall portions operable to form a substantially cylindrical member.

32. The invention according to claim 30, further comprising a reinforcement assembly disposed in either the lower vertical support system or the upper vertical support system.

33. The invention according to claim 32, wherein the reinforcement assembly includes a first portion and a second portion disposed on the first portion, wherein the first portion comprises a plurality of substantially elongated reinforcement members in fixed relationship to one another, wherein the second portion includes a bracket member fastened to an end portion of at least one of the reinforcement members.

34. The invention according to claim 32, wherein the support member comprises a cage member having a first end and a spaced and opposed second end defining a throughbore therebetween.

35. The invention according to claim 32, wherein the lower vertical form system is disposed entirely within the earthen hole and fully recessed below a grade surface thereof and the upper vertical form system is located above a grade surface of the earthen hole.

* * * * *